US008614041B2

(12) United States Patent
Matsuoka et al.

(10) Patent No.: US 8,614,041 B2
(45) Date of Patent: Dec. 24, 2013

(54) TONER FOR ELECTROPHOTOGRAPHY AND BINDER RESIN FOR TONER

(75) Inventors: Hiroshi Matsuoka, Ichihara (JP); Kazuya Sakata, Ichihara (JP); Hiroyuki Takei, Kamagaya (JP); Kenji Uchiyama, Odawara (JP); Ichiro Sasaki, Chiba (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 1043 days.

(21) Appl. No.: 12/519,819

(22) PCT Filed: Dec. 18, 2007

(86) PCT No.: PCT/JP2007/001420

§ 371 (c)(1),
(2), (4) Date: Jun. 18, 2009

(87) PCT Pub. No.: WO2008/075463

PCT Pub. Date: Jun. 26, 2008

(65) Prior Publication Data

US 2009/0311619 A1 Dec. 17, 2009

(30) Foreign Application Priority Data

Dec. 20, 2006 (JP) ..... 2006-342856

(51) Int. Cl.
*G03G 9/08* (2006.01)

(52) U.S. Cl.
USPC ..... 430/109.2; 430/137.18

(58) Field of Classification Search
USPC ..... 430/109.2, 137.18
See application file for complete search history.

(56) References Cited

U.S. PATENT DOCUMENTS

| | | | |
|---|---|---|---|
| 6,235,441 | B1 | 5/2001 | Tanikawa et al. |
| 7,244,538 | B2 | 7/2007 | Sakata et al. |
| 2002/0098431 | A1 | 7/2002 | Fujikawa et al. |
| 2005/0208410 | A1 | 9/2005 | Sakata et al. |

FOREIGN PATENT DOCUMENTS

| | | | |
|---|---|---|---|
| EP | 1 011 032 | A1 | 6/2000 |
| JP | 04-338972 | A | 11/1992 |
| JP | 7-043944 | A | 2/1995 |
| JP | 08-234480 | A | 9/1996 |
| JP | 08-292602 | A | 11/1996 |
| JP | 10-087837 | A | 4/1998 |
| JP | 11-282198 | A | 10/1999 |
| JP | 2000-235279 | A | 8/2000 |
| KR | 10-2005-0006233 | A | 1/2005 |
| WO | WO 2004/015498 | A1 | 2/2004 |

OTHER PUBLICATIONS

Extended Search Report from European Patent Office issued in corresponding European Patent Application No. 07849850.8 dated Aug. 4, 2011.

International Search Report (PCT/ISA/210) for PCT/JP2007/001420 dated Jan. 22, 2008.

Office Action from Korean Patent Office issued in corresponding Korean Patent Application No. 10-2009-7015066 dated Mar. 21, 2011.

Office Action from Chinese Patent Office issued in corresponding Chinese Patent Application No. 200780046883.8 dated May 25, 2011.

*Primary Examiner* — Jonathan Jelsma

(74) *Attorney, Agent, or Firm* — Buchanan Ingersoll & Rooney PC

(57) ABSTRACT

Disclosed is a toner for electrophotography containing at least a binder resin. This toner for electrophotography is characterized in that (a) the tetrahydrofuran (THF) soluble content in the toner has a first peak in the molecular weight region of not less than 2,000 but less than 5,000 and a second peak in the molecular weight region of not less than 100,000 but less than 200,000 in the chromatogram obtained by gel permeation chromatography (GPC); (b) the binder resin contains at least a carboxyl group-containing vinyl resin (C) and a glycidyl group-containing vinyl resin (E); and (c) the mass ratio of the styrene monomer to the acrylic monomer in the binder resin, namely (S/A), is not less than 4.6 but less than 8.5.

7 Claims, No Drawings

TONER FOR ELECTROPHOTOGRAPHY AND BINDER RESIN FOR TONER

TECHNICAL FIELD

The present invention relates to a toner for electrophotography used for development of an electrostatic image in electrophotography, electrostatic recording, electrostatic printing or the like, a method for producing a toner for electrophotography, and a binder resin for a toner.

BACKGROUND ART

In general, an electrophotography in a PPC (Plain Paper Copy) copier or a printer for transferring a toner image formed on a photo-sensitive material onto a recording sheet is carried out in a method described below. That is, an electrostatic latent image is formed on a photo-sensitive material, the latent image is developed by using a toner, the toner image is transferred onto a sheet to be fixed such as paper or the like, and then the transferred toner image is fixed by heating with a heat roll or a film. Since the fixation is carried out under heat at a state that the heat roll or the film is directly in contact with the toner on the sheet to be fixed, it is performed in a short period of time and with a very high thermal efficiency, thereby achieving a very good fixing efficiency. However, though having a good thermal efficiency, the heat fixing method has a problem of a so-called offset phenomenon. Namely, since a toner is contacted with the surface of the heat roll or the film in the melt state of the toner, the toner is transferred by adhering on the surface of the heat roll, and the transferred toner is transferred again on the next sheet to be fixed to contaminate it.

In order to obtain a resin excellent in fixing properties and offset resistance, there have been disclosed a high molecular weight resin and a low molecular weight resin used in mixture with each other, and a high molecular weight portion-crosslinked resin (for example, refer to Patent Document 1). Furthermore, in order to achieve low-temperature fixing properties and offset resistance, there has been disclosed a resin with viscoelasticity specified at 160 and 190 degrees centigrade (for example, refer to Patent Document 2). However, further improvement of fixing properties and offset resistance has been in demand.

Meanwhile, in late years, reduced environmental burdens have become an important object. As a method for producing a toner in general, there has been adopted a so-called kneading and grinding method in which a resin, a colorant, a charge controlling agent, a wax and the like are kneaded by the use of a kneader, cooled, finely ground by the use of a grinder, and then dispensed to give a toner. However, in the kneading and grinding method, much energy has been required for a grinding process. Accordingly, the improvement in the productivity has been in demand from the viewpoint of energy saving. By reducing cohesive force of a binder resin, it is possible to reduce grinding energy. However, the deterioration of durability was resulted in, and the productivity and durability of the toner could hardly be achieved.

Patent Document 1: Japanese Patent Laid-open No. 1998-87837

Patent Document 2: Japanese Patent Laid-open No. 1999-282198

DISCLOSURE OF THE INVENTION

The present invention is to solve the problems in such a conventional toner. That is, the present invention is to provide a toner excellent in balancing low-temperature fixing properties, offset resistance, cleaning properties, storage stability, durability and productivity, a method for producing a toner, and a binder resin suitable for the production of a toner.

The present inventors have conducted an extensive study and thus the present invention has been completed. That is, the present invention is specified by matters described in below:

(1) a toner for electrophotography containing at least a binder resin, wherein (a) the tetrahydrofuran (THF) soluble content in the toner has a first peak in the molecular weight region of not less than 2,000 but less than 5,000 and a second peak in the molecular weight region of not less than 100,000 but less than 200,000 in the chromatogram obtained by gel permeation chromatography (GPC); (b) the binder resin contains at least a carboxyl group-containing vinyl resin (C) and a glycidyl group-containing vinyl resin (E); and (c) the mass ratio of the styrene monomer to the acrylic monomer in the binder resin, namely (S/A), is not less than 4.6 but less than 8.5;

(2) the toner for electrophotography as set forth in (1), wherein, in the measurement frequency of 6.28 rad/s, both of the storage modulus G' at 155 degrees centigrade; G'(155 degrees centigrade) and the storage modulus G' at 165 degrees centigrade; G'(165 degrees centigrade) are not less than $1.0\times10^3$ Pa but not more than $2.0\times10^4$ Pa; both of the loss modulus G" at 155 degrees centigrade; G"(155 degrees centigrade) and the loss modulus G" at 165 degrees centigrade; G" (165 degrees centigrade) are not less than $1.0\times10^3$ Pa but not more than $1.5\times10^4$ Pa; G' (165 degrees centigrade)/G' (155 degrees centigrade) is not less than 0.80 but not more than 1.10; and G" (165 degrees centigrade)/G" (155 degrees centigrade) is not less than 0.65 but not more than 0.85;

(3) the toner for electrophotography as set forth in (1), wherein the THF insoluble component derived from the binder resin is contained in an amount of 1 to 30 mass %;

(4) a method for producing the toner for electrophotography as set forth in (1) comprising a step of kneading a binder resin satisfying all of the following conditions (i) to (viii) and at least a colorant in the melt state and then grinding, (i) the THF soluble content in the binder resin has a first peak in the molecular weight region of not less than 2,000 but less than 5,000 and a second peak in the molecular weight region of not less than 150,000 but less than 350,000 in the chromatogram obtained by GPC;

(ii) the binder resin contains at least a carboxyl group-containing vinyl resin (C) and a glycidyl group-containing vinyl resin (E);

(iii) the mass ratio of the styrene monomer to the acrylic monomer in the binder resin, namely (S/A), is not less than 4.6 but less than 8.5;

(iv) the carboxyl group-containing vinyl resin (C) contains a high molecular weight vinyl resin (H) in which the THF soluble content has a peak in the molecular weight region of not less than 150,000 but less than 350,000 in the chromatogram obtained by GPC and a low molecular weight vinyl resin (L) in which the THF soluble content has a peak in the molecular weight region of not less than 2,000 but less than 5,000 in the chromatogram obtained by GPC;

(v) the mass ratio of the high molecular weight vinyl resin (H) to the low molecular weight vinyl resin (L) in the carboxyl group-containing vinyl resin (C), namely (H/L), is not less than 30/70 but not more than 50/50;

(vi) the acid value of the carboxyl group-containing vinyl resin (C) is not less than 3 but not more than 16 mgKOH/g;

(vii) The glycidyl group-containing vinyl resin (E) has the THF soluble content which has a peak in the molecular weight region of not less than 20,000 but not more than 80,000 in the chromatogram obtained by GPC and the epoxy value of resin (E) is not less than 0.003 but not more than 0.100 Eq/100 g; and (viii) the mass ratio of the carboxyl group-containing vinyl resin (C) to the glycidyl group-containing vinyl resin (E), namely (C/E), is not less than 87/13 but not more than 99/1;

(5) the method for producing the toner for electrophotography as set forth in (4), in which a binder resin containing the THF insoluble component in an amount of not less than 0.1 but not more than 20 mass % is used;

(6) the method for producing the toner for electrophotography as set forth in (4), in which the acid value of the high molecular weight vinyl resin (H) in the binder resin, namely (AVH), is not less than 3.0 but not more than 32.5 mgKOH/g; the acid value of the low molecular weight vinyl resin (L), namely (AVL), is not less than 1.3 but not more than 16.5 mgKOH/g; and AVH is greater than AVL (AVH>AVL);

(7) the method for producing the toner for electrophotography as set forth in (4), in which the binder resin is obtained by melt-kneading at least one carboxyl group-containing vinyl resin (C) and at least one glycidyl group-containing vinyl resin (E) at a temperature range of not less than 140 but not more than 230 degrees centigrade and reacting the carboxyl group with the glycidyl group;

(8) a binder resin for a toner satisfying all of the following conditions (i) to (iii), (i) the resin contains at least a carboxyl group-containing vinyl resin (C) and a glycidyl group-containing vinyl resin (E);

(ii) the THF insoluble component is contained in an amount of not less than 0.1 but not more than 20 mass %; and the THF soluble content has a first peak in the molecular weight region of not less than 2,000 but less than 5,000 and a second peak in the molecular weight region of not less than 150,000 but less than 350,000 in the chromatogram obtained by GPC; and (iii) the ratio of the styrene monomer to the acrylic monomer in the binder resin, namely (S/A), is not less than 4.6 but less than 8.5;

(9) the binder resin for a toner as set forth in (8), satisfying all of the following conditions (i) to (v), (i) the carboxyl group-containing vinyl resin (C) contains a high molecular weight vinyl resin (H) in which the THF soluble content has a peak in the molecular weight region of not less than 150,000 but less than 350,000 in the chromatogram obtained by GPC and a low molecular weight vinyl resin (L) in which the THF soluble content has a peak in the molecular weight region of not less than 2,000 but less than 5,000 in the chromatogram obtained by GPC;

(ii) the mass ratio of the high molecular weight vinyl resin (H) to the low molecular weight vinyl resin (L) in the carboxyl group-containing vinyl resin (C), namely (H/L), is not less than 30/70 but not more than 50/50;

(iii) the acid value of the carboxyl group-containing vinyl resin (C) is not less than 3 but not more than 16 mgKOH/g;

(iv) the glycidyl group-containing vinyl resin (E) has the THF soluble content which has a peak in the molecular weight region of not less than 20,000 but not more than 80,000 in the chromatogram obtained by GPC and the epoxy value of the resin (E) is not less than 0.003 but not more than 0.100 Eq/100 g; and (v) the mass ratio of the carboxyl group-containing vinyl resin (C) to the glycidyl group-containing vinyl resin (E), namely (C/E), is not less than 87/13 but not more than 99/1;

(10) the binder resin for a toner as set forth in (8), wherein the acid value of the high molecular weight vinyl resin (H), namely (AVH), is not less than 3.0 but not more than 32.5 mgKOH/g; the acid value of the low molecular weight vinyl resin (L), namely (AVL), is not less than 1.3 but not more than 16.5 mgKOH/g; and AVH is greater than AVL (AVH>AVL); and

(11) the binder resin for a toner as set forth in (8), wherein the binder resin is obtained by melt-kneading at least one carboxyl group-containing vinyl resin (C) and at least one glycidyl group-containing vinyl resin (E) at a temperature range of 140 to 230 degrees centigrade and reacting the carboxyl group with the glycidyl group.

EFFECT OF THE INVENTION

According to the present invention, there are provided a toner excellent in balancing low-temperature fixing properties, offset resistance, cleaning properties, storage stability, durability and productivity, a method for producing a toner, and a binder resin suitable for the production of a toner.

BEST MODE FOR CARRYING OUT THE INVENTION

The present invention will be described in more detail below.

In the present invention, the term "polymerization" may be used for the meaning of copolymerization, and the term "polymer" may be used for the meaning of a copolymer in some cases.

Toner for Electrophotography

The toner for electrophotography of the present invention contains at least a binder resin, wherein (a) the tetrahydrofuran (THF) soluble content in the toner has a first peak in the molecular weight region of not less than 2,000 but less than 5,000 and a second peak in the molecular weight region of not less than 100,000 but less than 200,000 in the chromatogram obtained by gel permeation chromatography (GPC); (b) the binder resin contains at least a carboxyl group-containing vinyl resin (C) and a glycidyl group-containing vinyl resin (B); and (c) the mass ratio of the styrene monomer to the acrylic monomer in the binder resin, namely (S/A), is not less than 4.6 but less than 8.5.

In the toner for electrophotography of the present invention, the THF soluble content has a first peak in the molecular weight region of not less than 2,000 but less than 5,000 and preferably in the molecular weight region of not less than 3,000 but less than 4,800 in the chromatogram obtained by GPC. Furthermore, the THF soluble content has a second peak in the molecular weight region of not less than 100,000 but less than 200,000. Herein, the first peak refers to the highest peak in the chromatogram obtained by GPC, while the second peak refers to the second highest peak. The first peak and the second peak are in this region, whereby fixing properties, durability and storage stability of the toner become excellent. When the molecular weight of the first peak is not less than 2,000, storage stability and durability of the toner become excellent. When the molecular weight is less than 5,000, fixing properties become excellent; therefore, it is preferable. On the other hand, when the molecular weight of the second peak is not less than 100,000, resin strength can be prevented from being insufficient so that the durability is enhanced and occurrence of very small offset can be suppressed; therefore, it is preferable. Furthermore, when the molecular weight of the second peak is less than 200,000, fixing properties can be maintained excellent; therefore, it is preferable.

Incidentally, the molecular weight peak mentioned in the present invention also includes a shoulder peak, which is hereinafter the same.

The toner for electrophotography of the present invention contains at least a carboxyl group-containing vinyl resin (C) and a glycidyl group-containing vinyl resin (E). Such resins are contained, whereby a toner excellent in fixing properties and offset resistance can be achieved.

Examples of a monomer constituting the carboxyl group-containing vinyl resin (C) include a styrene monomer and an acrylic monomer (also including a methacrylic monomer, hereinafter the same), in addition to a carboxyl group-containing monomer. Furthermore, examples of a monomer constituting the glycidyl group-containing vinyl resin (E) include a glycidyl group-containing monomer, and in addition thereto, the aforementioned monomers.

Herein, examples of the styrene monomer used in the present invention include styrene, p-methylstyrene, m-methylstyrene, o-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene and the like. Particularly preferably used is styrene.

Examples of the acrylic monomer used in the present invention include acrylic esters such as methyl acrylate, ethyl acrylate, propyl acrylate, butyl acrylate, octyl acrylate, cyclohexyl acrylate, acrylonitrile, stearyl acrylate, benzyl acrylate, furfuryl acrylate, hydroxyethyl acrylate, hydroxybutyl acrylate, dimethylaminomethyl acrylate, dimethylaminoethyl acrylate and the like; methacrylic esters such as methyl methacrylate, ethyl methacrylate, propyl methacrylate, butyl methacrylate, octyl methacrylate, cyclohexyl methacrylate, methacrylonitrile, stearyl methacrylate, benzyl methacrylate, furfuryl methacrylate, hydroxyethyl methacrylate, hydroxybutyl methacrylate, dimethylaminomethyl methacrylate, dimethylaminoethyl methacrylate and the like; and amides such as acrylamide, methacrylamide, N-substituted acrylamide, N-substituted methacrylamide and the like. Among these, preferably used are acrylic esters, methacrylic esters, acrylonitrile and methacrylonitrile, and particularly preferably used are butyl acrylate, methyl methacrylate, butyl methacrylate and hydroxyethyl acrylate.

In the present invention, in addition to the above monomers, diesters of an unsaturated dibasic acid such as dimethyl fumarate, dibutyl fumarate, dioctyl fumarate, dimethyl maleate, dibutyl maleate, dioctyl maleate and the like can also be used as a monomer. These monomers are not an acrylic monomer, but it is calculated as an acrylic monomer when the ratio of the styrene monomer to the acrylic monomer, namely (S/A), to be described later, is calculated.

Examples of the carboxyl group-containing monomer in the present invention include mono esters of an unsaturated dibasic acid such as acrylic acid, methacrylic acid, maleic acid anhydride, maleic acid, fumaric acid, cinnamic acid, methyl fumarate, ethyl fumarate, propyl fumarate, butyl fumarate, octyl fumarate, methyl maleate, ethyl maleate, propyl maleate, butyl maleate, octyl maleate and the like. Preferably used are acrylic acid, methacrylic acid, fumaric acid, methyl fumarate, ethyl fumarate, propyl fumarate, butyl fumarate and octyl fumarate, and particularly preferably used are acrylic acid and methacrylic acid.

For the carboxyl group-containing vinyl resin (C) in the present invention, a crosslinkable monomer having two or more double bonds as necessary may be used as a monomer. Examples of the crosslinkable monomer include aromatic divinyl compounds such as divinyl benzene, divinyl naphthalene and the like; diacrylate compounds such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyoxyethylene(2)-2,2-bis(4-hydroxyphenyl) propane diacrylate, polyoxyethylene(4)-2,2-bis(4-hydroxyphenyl)propane diacrylate and the like, and methacrylate compounds thereof; and polyfunctional crosslinkable monomers such as pentaerythritol triacrylate, trimethylolethane triacrylate, trimethylolpropane triacrylate, tetramethylolmethane tetraacrylate and the like, and methacrylate compounds thereof. When these crosslinkable monomers are used, the crosslinkable monomer is preferably contained in an amount of less than 0.5 mass % based on 100 mass % of monomers other than the vinyl resin containing a carboxyl group other than such crosslinkable monomers. When the amount is not less than 0.5 mass %, a crosslinked body created by the reaction of the carboxyl group with the glycidyl group to be described below is cut in the production of a toner in some cases. The reason is considered that the crosslinked portion by the crosslinkable monomer is brittle to kneading shear in the production of a toner so that the crosslinked body is cut, and starting from the cut crosslinked portion due to the crosslinkable monomer, scission of other crosslinked portions is accelerated. In the present invention, when the content of the crosslinkable monomer in the binder resin is less than 0.3 mass %, it is not included in the calculation of the ratio of the styrene monomer to the acrylic monomer to be described below, namely (S/A).

The glycidyl group-containing vinyl resin (E) in the present invention is obtained by the use of a known polymerization method using at least one of the above monomers and at least one of the glycidyl group-containing monomers. In the present invention, to calculate the ratio of the styrene monomer to the acrylic monomer to be described later, namely (S/A), the glycidyl group-containing monomer is calculated as an acrylic monomer.

Examples of the glycidyl group-containing monomer in the present invention include glycidyl acrylate, β-methyl glycidyl acrylate, glycidyl methacrylate, β-methyl glycidyl methacrylate and the like, and preferably used are glycidyl methacrylate and β-methyl glycidyl methacrylate.

Meanwhile, in the toner for electrophotography of the present invention, the ratio of the styrene monomer to the acrylic monomer, namely (S/A), is not less than 4.6 but less than 8.5 and further not less than 4.9 but less than 7.9. Accordingly, a balance between more excellent fixing properties and offset resistance can be achieved while exhibiting excellent durability, productivity, storage stability and the like.

Meanwhile, in the toner for electrophotography of the present invention, it is preferable that, in the measurement frequency of 6.28 rad/s, the storage modulus G' at 155 degrees centigrade; G'(155 degrees centigrade) is not less than $1.0\times10^3$ Pa but not more than $2.0\times10^4$ Pa, the loss modulus G" at 155 degrees centigrade; G"(155 degrees centigrade) is not less than $1.0\times10^3$ Pa but not more than $1.5\times10^4$ Pa, the storage modulus G' at 165 degrees centigrade; G'(165 degrees centigrade) is not less than $1.0\times10^3$ Pa but not more than $2.0\times10^4$ Pa, and the loss modulus G" at 165 degrees centigrade; G"(165 degrees centigrade) is not less than $1.0\times10^3$ Pa but not more than $1.5\times10^4$ Pa. Furthermore, the ratio of G' (165 degrees centigrade) to G' (155 degrees centigrade), namely (G' (165 degrees centigrade)/G' (155 degrees centigrade)), is not less than 0.80 but not more than 1.10 and preferably not less than 0.85 but not more than 1.00, while the ratio of G" (165 degrees centigrade) to G" (155 degrees centigrade), namely (G" (165 degrees centigrade)/G" (155 degrees centigrade)), is not less than 0.65 but not more than 0.85 and preferably not less than 0.65 but not more than 0.80. In the present invention, it was found that by accurately controlling the viscoelasticity value at 155 and 165 degrees centigrade, the fixing of a toner onto paper can be achieved at a more excellent low temperature and at a faster fixing speed, which is not heretofore achieved. In particular, in the present invention, the most important factors are the ratio of G' (165 degrees centigrade) to G' (155 degrees centigrade), namely (G' (165 degrees centigrade)/G' (155 degrees centigrade)), and the ratio of G" (165 degrees centigrade) to G" (155 degrees centigrade), namely (G" (165 degrees centigrade)/G" (155 degrees centigrade)), from the viewpoint of achievement of more excellent fixing performance. When each loss modulus G" at 155 degrees centigrade and 165 degrees centigrade is not less than the lower limit, it is preferable because offset resistance becomes excellent, while when it is not more than the upper limit, it is preferable because fixing performance is enhanced. Furthermore, when each storage modulus G' at 155 degrees centigrade and 165 degrees centigrade is not less than the lower limit, it is preferable because offset resistance is sufficiently obtained, while when it is not more than the upper limit, it is preferable because fixing performance becomes excellent.

By having G' (165 degrees centigrade)/G' (155 degrees centigrade) within the above range, the toner exhibits excellent offset resistance. Furthermore, when G" (165 degrees centigrade)/G" (155 degrees centigrade) is smaller than the above range, the toner becomes brittle in some cases. In this case, when the print surface is rubbed, it is easily peeled off so that fixing properties might possibly be lowered.

The THF insoluble component in the binder resin component of the toner of the present invention is preferably contained in an amount of not less than 1 but less than 30 mass % and more preferably not less than 3 but not more than 25 mass %. By having the amount of the THF insoluble component within this range, offset resistance is enhanced, excellent fixing properties can be realized, and the toner productivity is enhanced because the toner becomes easily ground. When the amount of the THF insoluble component is not less than 1 mass %, offset resistance is sufficiently obtained, while when the amount of the THF insoluble component is less than 30 mass %, the loss modulus of the toner is prevented from being excessively high and excellent fixing performance is achieved. Furthermore, when the crosslinking component is excessively generated, the crosslinking component and other non-crosslinking component are excessively separated and the separated non-crosslinking component might possibly cause very small offset. Thus, the THF insoluble component is preferably within the above range.

Further, in the toner for electrophotography of the present invention, a glass transition temperature (Tg) obtained according to JIS K-7121 standard is preferably from 45 to 75 degrees centigrade and more preferably from 50 to 65 degrees centigrade. When Tg is not less than 45 degrees centigrade, storage stability is excellent, while when Tg is not more than 75 degrees centigrade, fixing properties can be sufficiently maintained.

Method for Producing a Toner

The toner of the present invention is produced according to a conventionally known method. For example, the following method can be cited. Firstly, the binder resin and a colorant, and as necessary other additives such as a releasing agent, a charge controlling agent and the like are sufficiently mixed using a powder mixer, and then the resulting mixture is melt-kneaded using a kneading machine such as a heat roll, a kneader or an extruder for sufficiently mixing individual components. The melt-kneaded material is cooled, ground and sieved to collect particles having a particle diameter of ordinarily 4 to 15 micro-meters. A surface treatment agent was used to the collected particles according to the powder mixing method, and obtain a toner. As necessary, the toner may be subjected to spherodizing treatment using a surface treatment device or the like. As a surface treatment method, there can be exemplified, for example, a method of subjecting the toner to spherodizing by inflowing it in a hot air jet and a method of taking an angle of the toner by mechanical impact.

Binder Resin

The binder resin used for the production of the toner of the present invention contains a carboxyl group-containing vinyl resin (C) and a glycidyl group-containing vinyl resin (E), and preferably contains the THF insoluble content generated by the reaction thereof.

The carboxyl group-containing vinyl resin (C) is obtained by polymerizing at least one styrene monomer, at least one acrylic monomer and at least one carboxyl group-containing monomer according to a known polymerization method. In the present invention, when the carboxyl group-containing monomer is an acrylic monomer, the carboxyl group-containing monomer is calculated as an acrylic monomer. Herein, as the carboxyl group-containing monomer, a styrene monomer and an acrylic monomer, the aforementioned monomers can be cited.

It is preferable that the carboxyl group-containing vinyl resin (C) of the present invention contains a high molecular weight vinyl resin (H) and a low molecular weight vinyl resin (L).

In the present invention, as a method for producing a carboxyl group-containing vinyl resin (C) and a glycidyl group-containing vinyl resin (E), known polymerization methods such as solution polymerization, bulk polymerization, suspension polymerization, emulsion polymerization and the like, and the combination thereof can be adopted. Preferably, solution polymerization, bulk polymerization and the combination of solution polymerization and bulk polymerization are adopted from the viewpoints of adjustment of the molecular weight distribution, mixing properties of the high molecular weight vinyl resin (H) and the low molecular weight vinyl resin (L) to be described below, and convenience of distribution adjustment of the carboxyl group and the glycidyl group.

The carboxyl group-containing vinyl resin (C) of the present invention can be obtained by polymerizing each of the high molecular weight vinyl resin (H) and the low molecular weight vinyl resin (L) alone in advance, and then mixing the respective resins in the melt state or the solution state. Further, it can be obtained by polymerizing any one of the high molecular weight vinyl resin (H) or the low molecular weight vinyl resin (L) alone, and then polymerizing the other vinyl resin in the presence of the former vinyl resin.

Examples of the solvent used for solution polymerization include aromatic hydrocarbon solvents such as benzene, toluene, ethylbenzene, xylene, cumene and the like. These solvents may be used alone or may be used as a mixture, and preferably used is xylene.

Polymerization may be carried out by using a polymerization initiator or so-called thermal polymerization may be carried out without using a polymerization initiator. As a polymerization initiator, any polymerization initiators can be usually used as far as they can be used as radical polymerization initiators. Examples thereof include azo initiators such as 2,2'-azobisisobutyronitrile, 2,2'-azobis(4-methoxy-2,4-dimethylvaleronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis (2-methyl-propane) and the like; ketone peroxides such as methylethylketone peroxide, acetylacetone peroxide, cyclohexanone peroxide and the like; peroxy ketals such as 1,1-bis (t-butylperoxy)-3,3,5-trimethylcyclohexane, 1,1-bis(butylperoxy)cyclohexane, 2,2-bis(t-butylperoxy)butane and the like; hydroperoxides such as t-butyl hydroperoxide, cumene hydroperoxide, 1,1,3,3-tetramethylbutyl hydroperoxide and the like; dialkyl peroxides such as di-t-butyl peroxide, t-butylcumyl peroxide, dicumyl peroxide, 2,5-dimethyl-2,5-di(t-butylperoxy)hexane, α,α'-bis(t-butylperoxyisopropyl)benzene and the like; diacyl peroxides such as isobutyryl peroxide, octanoyl peroxide, decanoyl peroxide, lauroyl peroxide, 3,5,5-trimethylhexanoyl peroxide, benzoyl peroxide, m-toluoyl peroxide and the like; peroxydicarbonates such as diisopropyl peroxydicarbonate, di-2-ethylhexyl peroxydicarbonate, di-n-propyl peroxydicarbonate, di-2-ethoxyethyl peroxycarbonate, di-methoxyisopropyl peroxydicarbonate, di(3-methyl-3-methoxybutyl)peroxycarbonate and the like; sulfonyl peroxides such as acetylcyclohexyl sulfonyl peroxide and the like; and peroxyesters such as t-butyl peroxyacetate, t-butyl peroxyisobutyrate, t-butyl peroxyneodecanoate, cumyl peroxyneodecanoate, t-butyl peroxy-2-ethylhexanoate, t-butyl peroxy laurate, t-butyl peroxy benzoate, t-butyl peroxy isopropyl carbonate, di-t-butyldiperoxy isophthalate and the like. These initiators may be used singly or in combination of two or more kinds. The type and amount of the polymerization initiator can be properly selected depending on the reaction temperature, concentration of the monomer and the like. The polymerization initiator is usually used in an amount of 0.01 to 10 mass % per 100 mass % of the monomer in use.

High Molecular Weight Vinyl Resin (H)

In the present invention, the high molecular weight vinyl resin (H) contains the THF soluble content having a peak in the molecular weight region of not less than 150,000 but less than 350,000 and more preferably not less than 170,000 but less than 300,000 in the chromatogram obtained by GPC. It is preferable because a balance between excellent durability, fixing properties and offset resistance is realized. When the peak molecular weight is not less than 150,000, resin strength becomes excellent and durability is enhanced when it is used for a toner. Furthermore, in the formation of a crosslinked body by the reaction with the glycidyl group to be described below, insufficient formation of the crosslinked body can be prevented and offset resistance can be maintained excellent. When the molecular weight of the THF soluble content is excessively high, the viscosity of the binder resin is easily increased by the reaction with the glycidyl group-containing vinyl resin. However, when it is adjusted to the proper range of the viscoelasticity of the toner, unreacted high molecular weight vinyl resin easily remains in large quantities, and unreacted high molecular weight vinyl resin causes deterioration of the fixing properties in some cases. Accordingly, the molecular weight is preferably less than 350,000.

For the high molecular weight vinyl resin (H), the acid value (AVH) is not less than 3.0 but not more than 32.5 mgKOH/g, more preferably not less than 6.0 but not more than 23.0 mgKOH/g and further preferably not less than 9.0 but not more than 19.0 mgKOH/g from the viewpoints of the fixing properties and offset resistance of the toner. In order to accelerate the reaction with the glycidyl group-containing vinyl resin to be described later and enhance offset resistance of the toner, the acid value is preferably not less than 3.0 mgKOH/g. Furthermore, excessive reaction with glycidyl group-containing vinyl resin causes excessive increase of resin viscosity. Therefore, the acid value is preferably not more than 32.5 mgKOH/g in order to suppress the excessive increase of loss modulus in the fixing temperature region of the toner and realize excellent fixing performance. Incidentally, in the present invention, the acid value refers to mg of potassium hydroxide necessary to neutralize 1 g of the resin.

In the high molecular weight vinyl resin (H), the ratio of the styrene monomer to the acrylic monomer, namely (S/A), is preferably in the range of not less than 1.8 but not more than 5.7 and further preferably in the range of not less than 2.3 but not more than 4.0 since more excellent fixing properties and offset resistance of the toner are achieved.

The high molecular weight vinyl resin (H) may not be necessarily a single polymer, or two or more high molecular weight vinyl resins may be used. In that case, the high molecular weight vinyl resins (H) may preferably satisfy the above characteristics as a whole. Further, to produce a single polymer, the carboxyl group-containing monomer is added in the middle of polymerization or added separately at the beginning and end of polymerization, whereby it is possible to have the heterogeneous distribution of carboxyl group in the high molecular weight vinyl resin (H).

Low Molecular Weight Vinyl Resin (L)

In the present invention, the low molecular weight vinyl resin (L) contains the THF soluble content having a peak in the molecular weight region of not less than 2,000 but less than 5,000 in the chromatogram obtained by GPC. It is preferable because excellent fixing performance is obtained. Further, in order to prevent adverse effect on storage stability and durability of the toner, the peak molecular weight is preferably not less than the above lower limit. Furthermore, in order to prevent deterioration of the fixing performance, the peak molecular weight is preferably not more than the above upper limit.

For the low molecular weight vinyl resin (L), the acid value (AVL) is preferably not less than 1.3 but not more than 16.5 mgKOH/g and further preferably not less than 3.0 but not more than 10.0 mgKOH/g since excellent fixing performance and offset resistance performance are exhibited. When the acid value (AVL) is not less than 1.3 mgKOH/g, the compatibility with the high molecular weight vinyl resin (H) becomes excellent, and deterioration of the durability and occurrence of very small offset can be prevented. Also, the acid value is preferably not more than the above upper limit since excessive reactivity with the glycidyl group-containing vinyl resin (E) substantially hinders the reaction of the glycidyl group-containing vinyl resin (E) with the high molecular weight vinyl resin (H) and this preferable acid value also prevents the low molecular weight vinyl resin (L) from becoming a high molecular weight resin. Accordingly, it is preferable because offset resistance and fixing properties are enhanced.

For the low molecular weight vinyl resin (L), the ratio of the styrene monomer to the acrylic monomer, namely (S/A), is preferably not less than 8.0 and further preferably not less than 11.0 from the viewpoint of realization of more excellent fixing properties and offset resistance performance of the toner. The upper limit of S/A is preferably 99.0.

The acid value of the low molecular weight vinyl resin (L) (AVL) and the acid value of the high molecular weight vinyl resin (H) (AVH) satisfying AVH>AVL are preferable from the viewpoint of realization of balancing more excellent fixing properties and offset resistance performance of the toner. More preferably, its difference is preferably not less than 1.9 mgKOH/g and further preferably not less than 3.2 mgKOH/g. The crosslinking component greatly contributes to exhibition of offset resistance in the toner of the present invention by the reaction of the high molecular weight vinyl resin (H) with the glycidyl group-containing vinyl resin (E). In case of AVH≤AVL, the reactivity of the low molecular weight vinyl resin (L) with the glycidyl group-containing vinyl resin (E) tends to be increased. Thus, the reaction of the glycidyl group-containing vinyl resin (E) with the high molecular weight vinyl resin (H) is substantially hindered in some cases and the low molecular weight vinyl resin (L) per se becomes a high molecular weight resin, whereby deterioration of offset resistance and deterioration of fixing properties might possibly be caused.

The low molecular weight vinyl resin (L) necessarily has the above characteristics, but it may not be necessarily a single polymer, or two or more low molecular weight vinyl resins may be used. In that case, the low molecular weight vinyl resins (L) may preferably satisfy the aforementioned characteristics as a whole. Further, to produce a single polymer, the carboxyl group-containing monomer is added in the middle of polymerization or added separately at the beginning and end of polymerization, whereby it is also possible to have the heterogeneous distribution of carboxyl group in the low molecular weight vinyl resin (L).

Carboxyl Group-Containing Vinyl Resin (C)

When the carboxyl group-containing vinyl resin (C) is composed of the high molecular weight vinyl resin (H) and the low molecular weight vinyl resin (L), its ratio (H/L) is preferably not less than 30/70 but more than 50/50 and more preferably not less than 35/65 but not more than 45/55 from the viewpoint of a total balance between productivity, fixing properties, offset resistance and durability of the toner. When the ratio of the high molecular weight vinyl resin (H) is not less than 30 mass %, the durability and offset resistance become excellent when it is used for a toner. When the ratio is not more than 50 mass %, it is preferable because the fixing properties and productivity of the toner become excellent.

For the carboxyl group-containing vinyl resin (C), the acid value is preferably not less than 3 but not more than 16 mgKOH/g and further preferably not less than 5 but not more than 12 mgKOH/g. When the acid value is not less than 3 mgKOH/g, the reaction with the glycidyl group-containing vinyl resin (E) is accelerated and as a result, offset resistance becomes excellent when it is used for a toner. Further, unreacted high molecular weight vinyl resin (H) to be remained can be prevented from being excessively high and the fixing properties of the low molecular weight vinyl resin (L) can be maintained excellent. Also, when the acid value is excessively high, the reaction with the glycidyl group-containing vinyl resin excessively proceeds and the crosslinking component is excessively phase-separated from the non-crosslinking component, whereby offset resistance effect is damaged by the crosslinking component in some cases. In order to prevent this, the acid value is preferably not more than the above upper limit.

Glycidyl Group-Containing Vinyl Resin (E)

The glycidyl group-containing vinyl resin (E) contains the THF soluble content having a peak in the molecular weight region of not less than 20,000 but not more than 80,000, more preferably not less than 30,000 but not more than 700,000 and further preferably not less than 40,000 but not more than 60,000 in the chromatogram obtained by GPC. And its epoxy value is preferably not less than 0.003 but not more than 0.100 Eq/100 g, more preferably not less than 0.007 but not more than 0.045 Eq/100 g and further preferably not less than 0.010 but not more than 0.032 Eq/100 g. The low molecular weight component and the high molecular weight component containing a crosslinking component are in the optimum phase-separated state, whereby the binder resin used in the present invention can exhibit more excellent fixing performance and offset resistance performance unattainable by the prior art technique while having excellent durability, storage stability and productivity. In view of this, the peak molecular weight and the epoxy value of the glycidyl group-containing vinyl resin (E) become one of important control factors. When the peak molecular weight is not less than 20,000, the durability becomes excellent when it is used for a toner, the feature of maintaining development is enhanced. And the crosslinking formation is sufficiently obtained, thus, it is preferable from the viewpoint of offset resistance performance. Herein, the feature of maintaining development refers to a feature of a printed image quality which is not reduced over a long period of time. For example, when the toner is brittle, toner particles become insufficient due to stress in the unit, and atomized toner contaminates a carrier, a photo-sensitive material, a cleaning blade, other members in the unit in contact with the toner and the like in some cases. As a result, an initial image quality is damaged in some cases. In such a case, the feature of maintaining development becomes worsened. Further, when the peak molecular weight is not less than 20,000 and the epoxy value is not more than 0.100 Eq/100 g, excellent offset resistance is obtained. When the peak molecular weight is excessively low and the epoxy value is excessively high, in the reaction of the carboxyl group with the glycidyl group to be described later, the molecular weight among the crosslinked points becomes small, the crosslinked high molecular weight component is excessively phase-separated from the non-crosslinking low molecular weight component as the reaction proceeds in some cases, and offset resistance might possibly be damaged. On the other hand, when the peak molecular weight is excessively high and the epoxy value is excessively small, deterioration of fixing properties and deterioration of the toner productivity are caused in some cases. It is considered that this is caused by the fact that when the peak molecular weight is excessively high, the high molecular weight component hinders fixing properties of the low molecular weight component onto paper in some cases, and grinding is hardly conducted so that the productivity is reduced. In the present invention, the epoxy value refers to mole of the epoxy group present in 100 g of the resin, and it can be measured in accordance with JIS K-7236.

The glycidyl group-containing vinyl resin (E) may not be necessarily a single polymer, or two or more glycidyl group-containing vinyl resins may be used. In that case, the glycidyl group-containing vinyl resins (E) preferably satisfy the above characteristics as a whole. Further, to produce a single polymer, the glycidyl group-containing monomer is added in the middle of polymerization or added separately at the beginning and end of polymerization, whereby it is also possible to have the heterogeneous distribution of carboxyl group in the glycidyl group-containing vinyl resin (E).

Binder Resin

The preferable binder resin used in the present invention contains at least a carboxyl group-containing vinyl resin (C) and a glycidyl group-containing vinyl resin (E). The ratio of the carboxyl group-containing vinyl resin (C) to the glycidyl group-containing vinyl resin (E), namely (C/E), is not less than 87/13 but not more than 99/1 and preferably not less than 90/10 but not more than 97/3 in terms of the mass ratio from the viewpoint of offset resistance. When the ratio of the glycidyl group-containing vinyl resin (E) is not more than 13 mass %, it is preferable from the viewpoint of offset resistance. When the ratio of the glycidyl group-containing vinyl resin (E) is excessively high, in the reaction of the carboxyl group with the glycidyl group to be described later, the molecular weight among the crosslinked points becomes small and the crosslinking component is excessively shrunk as the reaction proceeds, so that the crosslinking component might possibly be excessively phase-separated from the non-crosslinking component without letting the low molecular weight component get into a network structure of crosslinking component. As a result, it is considered that offset resistance might possibly be adversely affected by the crosslinking component. On the other hand, when the ratio of the glycidyl group-containing vinyl resin (E) is not less than 1 mass %, the crosslinking component is sufficiently generated by the reaction of the carboxyl group-containing vinyl resin with the glycidyl group-containing vinyl resin and excellent offset resistance is obtained; therefore, it is preferable.

The preferable binder resin used in the present invention contains the THF insoluble component derived from the crosslinking component generated by the reaction of the carboxyl group derived from the carboxyl group-containing vinyl resin (C) with the glycidyl group derived from the glycidyl group-containing vinyl resin (E). The THF insoluble component in the binder resin is not less than 0.1 but more than 20 mass % and preferably not less than 0.5 but more than 17 mass % from the viewpoints of excellent fixing properties, offset resistance and the feature of maintaining development. When the THF insoluble component is not less than 0.1 mass %, offset resistance becomes excellent when it is used for a toner. The THF insoluble component is preferably not less than the above lower limit since excessively small THF insoluble component may cause poor dispersion of toner components such as a releasing agent, a charge controlling agent, a colorant, magnetic powder or the like, due to the insufficient kneading shear when toner components and the binder resin of the present invention are kneaded and ground to produce a toner, which may result in non-uniform electrification or poor environmental stability affecting developing performance adversely. When the THF insoluble component is not more than 20 mass %, the loss modulus of the toner is prevented from being excessively high and excellent fixing performance is achieved. When the crosslinking component is excessively generated, the low molecular weight component is excessively separated from the crosslinked component and the separated low molecular weight component might possibly cause very small offset. So, the THF insoluble component is preferably not more than the above upper limit.

It is preferable that the THF soluble content in the binder resin of the present invention has a first peak in the molecular weight region of not less than 2,000 but less than 5,000 and more preferably not less than 3,000 but less than 4,800, and a second peak in the molecular weight region of not less than 150,000 but less than 350,000 and more preferably not less than 160,000 but less than 300,000 in the chromatogram obtained by GPC. The first peak is derived from the low molecular weight vinyl resin (L), and the first peak is preferably in the molecular weight region of not less than 2,000 from the viewpoints of storage stability and durability. Further, the molecular weight of less than 5,000 is preferable from the viewpoint of fixing properties. On the other hand, the second peak is derived from the high molecular weight vinyl resin (H). Since the high molecular weight vinyl resin (H) is insolubilized from those having a higher molecular weight during the crosslinkage reaction, the peak molecular weight after crosslinking becomes smaller than the peak molecular weight before crosslinking. When the crosslinkage reaction excessively proceeds so that the second peak becomes excessively small, fixing properties possibly become worsened and very small offset also occurs. Furthermore, when the second peak is excessively small due to the fact that the molecular weight of the high molecular weight vinyl resin (H) is low, resin strength is insufficient in some cases. Accordingly, from the viewpoint of durability when it is used for a toner, the second peak is preferably in the molecular weight region of not less than 150,000. Further, in order to achieve excellent fixing properties, the second peak is preferably in the molecular weight region of not more than 350,000.

Incidentally, the second peak in the THF soluble component of the toner is derived from the second peak of the binder resin. By heating in the melt-kneading step for the production of a toner, the crosslinkage reaction proceeds, the second peak of the toner becomes smaller than the second peak of the binder resin and the crosslinking component is also increased. Further, the second peak of the binder resin is preferably 10,000 or more greater than the second peak of the toner. By satisfying this condition, even when the crosslinking component in the binder resin for kneading in the production of a toner is cut, the cut crosslinking component can be supplemented. As a result, sufficient offset resistance is achieved when it is used for a toner. Further, since kneading shear can be sufficiently applied, dispersion of the toner member can be excellent, uniform electrification is achieved and environmental stability is improved; therefore, it is preferable.

As a method for reacting the carboxyl group-containing vinyl resin (C) with the glycidyl group-containing vinyl resin (E), preferably used is a method involving mixing the carboxyl group-containing vinyl resin (C) and the glycidyl group-containing vinyl resin (E) in the melt state for the reaction. As such a method, any conventionally known methods, for example, a method involving introducing both resins into a reaction container equipped with a stirrer or the like and heating the resulting material for the reaction in the melt state or a method involving reacting both resins in the presence of a solvent and removing the solvent, can be adopted, but particularly preferably used is a method employing a twin screw kneader. Concrete examples thereof include a method involving mixing powders of the carboxyl group-containing vinyl resin (C) and the glycidyl group-containing vinyl resin (E) by the use of a Henschel mixer or the like, and then conducting melt-kneading and reaction using a twin screw kneader, and a method involving feeding the carboxyl group-containing vinyl resin (C) and the glycidyl group-containing vinyl resin (E) in the melt state to a twin screw kneader for conducting melt-kneading and reaction. The temperature for conducting melt-kneading and reaction is different depending on the types of the carboxyl group-containing vinyl resin (C) and the glycidyl group-containing vinyl resin (E), but it is in the range of not less than 140 but not more than 230 degrees centigrade and preferably in the range of not less than 150 but not more than 220 degrees centigrade. When the reaction temperature is excessively low, the reaction speed is lowered and offset resistance is inferior without sufficiently forming a crosslinked body in some cases. When the reaction temperature is excessively high, depolymerization occurs so that the volatile content remained in the binder resin is increased and there occurs a problem in the feature of maintaining development of the toner or odor in some cases.

In melt-kneading and reaction as described above, for the purpose of improved dispersion of the releasing agent in the toner, a releasing agent to be described below may be mixed with the carboxyl group-containing vinyl resin (C) and the glycidyl group-containing vinyl resin (E) to conduct melt-kneading and reaction. Further, a releasing agent may be added during any step of producing the carboxyl group-containing vinyl resin (C) and/or the glycidyl group-containing vinyl resin (E). After producing the carboxyl group-containing vinyl resin (C) and/or the glycidyl group-containing vinyl resin (E) containing a releasing agent, melt-kneading and reaction as described above may be carried out. According to these methods, excellent dispersion state of the releasing agent can be achieved. The amount of the releasing agent added at this time is preferably not more than 10 mass parts, based on 100 mass parts of the binder resin.

The thus-obtained resin is cooled and ground to give a binder resin for a toner. As a method for cooling and grinding, any of conventionally known methods can be adopted, and as a method for cooling, a steel belt cooler or the like can also be used for rapid cooling.

For the binder resin of the present invention, a structure of the crosslinking component, the reaction degree of the carboxyl group-containing vinyl resin (C) and the glycidyl group-containing vinyl resin (E), the amount ratio of the carboxyl group contained in the high molecular weight vinyl resin (H) and the low molecular weight vinyl resin (L), respective peak molecular weights and the like are adjusted in the optimum range. Accordingly, it is considered that a proper phase separation structure is formed between the low molecular weight component and the high molecular weight component containing a crosslinking component as well in the binder resin so that unprecedented excellent fixing performance and offset resistance performance are exhibited. That is, when a proper phase separation structure is not formed between the low molecular weight component and the high molecular weight component containing a crosslinking component as well, thermal motion by heating of the low molecular weight component is suppressed by an inter-molecular force with the high molecular weight component. As a result, the toner cannot be fully fixed onto paper. On the contrary, when the phase separation structure is excessively large, it is supposed that a portion without having a high molecular weight component in the toner takes place, and very small offset occurs when such a portion is fixed with a heat roller. It is considered that the binder resin of the present invention exhibits excellent fixing performance without hindering thermal motion of the low molecular weight component by the high molecular weight component while maintaining excellent offset resistance since the phase separation structure is adjusted in an optimum size. In order to achieve such a proper phase separation structure, in addition to the aforementioned factors, the ratio of the styrene monomer to the acrylic monomer in the binder resin, namely (S/A), is preferably not less than 4.6 but less than 8.5 and further preferably not less than 4.9 but less than 7.9. In the present invention, the acrylic monomer in the binder resin is mainly contained in the high molecular weight vinyl resin (H) of the carboxyl group-containing vinyl resin (C), while the acrylic monomer in the low molecular weight vinyl resin (L) is smaller as compared to that in the high molecular weight vinyl resin (H). Therefore, in the present invention, the S/A ratio of the binder resin is an index indicating different compositions of the high molecular weight component containing a crosslinking component as well and the low molecular weight component, and is one index of the compatibility between the high molecular weight component containing a crosslinking component as well and the low molecular weight component. Based on the aforementioned reason, a balance between excellent fixing properties and offset resistance is achieved so that the ratio of the styrene monomer to the acrylic monomer in the binder resin, namely (S/A), is preferably in this range.

Releasing Agent

It is preferable that the toner for electrophotography of the present invention contains a releasing agent in order to exhibit excellent fixing performance and offset resistance performance. As a releasing agent, conventionally known releasing agents can be used, and examples thereof include aliphatic hydrocarbon wax such as low molecular weight polyethylene, low molecular weight polypropylene, polyolefin copolymer, polyolefin wax, paraffin wax, microcrystalline wax, Fisher-Tropsch wax and the like; oxides of aliphatic hydrocarbon wax such as oxidized polyethylene wax; vegetable wax such as candelilla wax, carnauba wax, Japan wax, rice wax and jojoba wax; animal wax such as bee wax, lanolin and whale wax; mineral wax such as ozokerite, ceresin and petrolatum; wax principally constituted of aliphatic esters such as montanic ester wax and castor wax; and totally or partially deacidified aliphatic esters such as deacidified carnauba wax. Further, examples include saturated linear aliphatic acids such as palmitic acid, stearic acid and montanic acid or long-chain alkyl carboxylic acids having a long-chain alkyl group; unsaturated aliphatic acids such as brassidic acid, eleostearic acid and parinaric acid; saturated alcohols such as stearyl alcohol, eicosyl alcohol, behenyl alcohol, carnaubyl alcohol, ceryl alcohol and melissyl alcohol, or long-chain alkyl alcohol having a long-chain alkyl group; polyhydric alcohols such as sorbitol; aliphatic amides such as linolamide, oleylamide and laurylamide; saturated aliphatic acid bisamides such as methylene bisstearylamide, ethylene biscaprylamide, ethylene bislaurylamide and hexamethylene bisstearylamide; unsaturated aliphatic acid amides such as ethylene bisoleylamide, hexamethylene bisoleylamide, N,N'-dioleyladipylamide and N,N'-dioleylsebacylamide; aromatic bisamides such as m-xylene bisstearylamide and N,N'-distearylisophthalylamide; aliphatic metal salts such as calcium stearate, calcium laurate, zinc stearate and magnesium stearate; wax formed by grafting vinyl monomers such as a styrene monomer, an acrylic monomer, a carboxyl group-containing monomer and a glycidyl group-containing monomer to aliphatic hydrocarbon wax; partial esters of aliphatic acid and polyhydric alcohol such as behenic acid monoglyceride; and methyl ester compounds having a hydroxyl group obtained by hydrogenating vegetable fats and oils. Further, examples include an n-paraffin mixture obtained from higher aliphatic hydrocarbon or petroleum fraction having one or more double bonds obtained by an ethylene polymerization method or an olefination method by pyrolysis of petroleum hydrocarbons; wax having a functional group such as a hydroxyl group, an ester group, a carboxyl group or the like obtained by subjecting polyethylene wax obtained by an ethylene polymerization method or higher aliphatic hydrocarbon obtained by a Fisher-Tropsch synthesis to liquid-phase oxidation with a molecular oxygen-containing gas in the presence of boric acid and boric acid anhydride; Waxes obtained by metallocene-catalysed polymerization, such as polyethylene, polypropylene, polybutene, polypentene, polyhexene, polyheptane, polyoctene, ethylene-propylene copolymer, ethylene-butene copolymer, butene-propylene copolymer. Ester group-containing waxes obtained by the condensation reaction of long-chain alkylcarboxylic acid with polyhydric alcohol or the reaction of a halide of long-chain alkylcarboxylic acid with polyhydric alcohol. These releasing agents may be used singly or in combination of two or more kinds. In the toner for electrophotography of the present invention, a melting point of the releasing agent is preferably not less than 70 but not more than 150 degrees centigrade in consideration of a balance between storage stability, fixing properties and offset resistance of the toner. Furthermore, in order to enhance fixing properties of the toner, it is more preferable to use a releasing agent having a melting point of not more than 110 degrees centigrade. In order to enhance offset resistance of the toner, it is more preferable to use a releasing agent having a melting point of not less than 100 degrees centigrade. In the toner for electrophotography of the present invention, the amount of the releasing agent added is not less than 0.2 but not more than 12 mass parts, preferably not less than 1 but not more than 10 mass parts and further preferably not less than 2 but not more than 8 mass parts, based on 100 mass parts of the binder resin. These releasing agents can be added in the middle of producing the toner, can be added into the polymer component as described above, can be added during the reaction of the carboxyl group with the glycidyl group, or these addition methods may be further used in combination.

Charge Controlling Agent

It is preferable that the toner for electrophotography of the present invention contains a charge controlling agent in order to keep a positive electrostatic-charging property or a negative electrostatic-charging property. As a charge controlling agent, conventionally known charge controlling agents may be used. Examples of the positive charge controlling agent include nigrosin and modified nigrosins of its aliphatic metal salts; quaternary ammonium salts such as tributylbenzylammonium-1-hydroxy-4-naphtosulfonate salt and tetrabutylammonium tetrafluoro borate, and onium salts such as their phosphonium salts that are analogs of those compounds and the lake pigments thereof; triphenylmethane dyes and lake pigments thereof (laking agents: phosphorus tungstic acid, phosphorus molydenic acid, phosphorus tungsten molybdenic acid, tannic acid, lauric acid, gallic acid, ferricyanide, ferrocyanide and the like); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; guanidine compounds, imidazole compounds, and imidazolium salts. Further, examples include quaternary ammonium salt group-containing copolymers obtained by a means of quaternization or the like with para-toluenesulfonic acid alkyl ester after copolymerizing dialkylaminoalkyl (meth)acrylate and a styrene monomer and as necessary an acrylic monomer. As the negative charge controlling agent, an organic metal complex and a chelate compound are effective, and examples thereof include a mono-azo metal complex, an acetylacetone metal complex, an aromatic hydroxycarboxylic acid metal complex, an aromatic dicarboxylic acid metal complex; aromatic hydroxycarboxylic acid, aromatic carboxylic acid or aromatic polycarboxylic acid and metal salts thereof, anhydride, esters, and bisphenol derivative such as bisphenol. Further, examples include azo metal compounds having a coordination center metal selected from Sc, Ti, V, Cr, Co, Ni, Mn and Fe, and cation selected from hydrogen ion, sodium ion, potassium ion and ammonium ion; aromatic hydroxycarboxylic acid derivative having a coordination center metal selected from Cr, Co, Ni, Mn, Fe, Ti, Zr, Zn, Si, B and Al, and cation selected from hydrogen ion, sodium ion, potassium ion, ammonium ion and aliphatic ammonium; metal compounds of aromatic polycarboxylic acid derivatives (aromatic hydroxycarboxylic acid derivative and aromatic polycarboxylic acid may have an alkyl group, an aryl group, a cycloalkyl group, an alkenyl group, an alkoxy group, an aryloxy group, a hydroxyl group, an alkoxycarbonyl group, an aryloxycarbonyl group, an acyl group, an acyloxy group, a carboxyl group, halogen, a nitro group, a cyano group, an amide group, an amino group or a carbamoyl group as a substituent); and a polymer having a sulfonic acid group-containing monomer such as a copolymer of a sulfonic acid group-containing acrylamide monomer, a styrene monomer and an acrylic monomer as a constituent component. These charge controlling agents may be used singly or in combination of two or more kinds. The amount of the charge controlling agent added into the toner is preferably not less than 0.05 but not more than 10 mass %, more preferably not less than 0.1 but not more than 5 mass % and further preferably not less than 0.2 but not more than 3 mass %, based on 100 mass % of the binder resin, from a balance between the charge amount and fluidity of the toner. Further, as a method of adding the charge controlling agent, a method of adding it into the inside of the toner, a method of externally adding, or a combination thereof can be applied.

Colorant

The toner for electrophotography of the present invention contains a colorant. As a colorant, conventionally known dyes and pigments may be used. Concrete examples thereof include carbon black, acetylene black, lamp black, aniline black, naphthol yellow, Hansa yellow, permanent yellow, benzidine yellow, chrome yellow, yellow iron oxide, quinoline yellow lake, molybdenum orange, Balkan orange, Indanthrene, brilliant orange GK, red ocher, brilliant carmin 6B, Frizarin lake, methyl violet lake, fast violet B, permanent red, lake red, rhodamine lake, alizarin lake, phthalocyanine blue, Indanthrene blue, Peacock blue, cobalt blue, alkali blue lake, fast sky blue, pigment green B, malachite green lake, titanium oxide, oil black, azo oil black, azo type dyes, anthraquinone type dyes, xanthene type dyes, methine type dyes and the like. These colorants may be used singly or in combination of two or more kinds. The amount of the colorant added into the toner is preferably not less than 0.05 but not more than 20 mass %, more preferably not less than 0.1 but not more than 15 mass % and further preferably not less than 0.2 but not more than 10 mass %, based on 100 mass % of the binder resin.

Meanwhile, a magnetic material may be used instead of these colorants. Examples of the magnetic material include metal oxides containing elements such as iron, cobalt, nickel, copper, magnesium, manganese, aluminum, silicon and the like. Concrete examples thereof include triiron tetraoxide, iron sesquioxide, zinc iron oxide, yttrium iron oxide, cadmium iron oxide, gadolinium iron oxide, copper iron oxide, lead iron oxide, nickel iron oxide, neodymium iron oxide, barium iron oxide, magnesium iron oxide, manganese iron oxide, lanthanum iron oxide, iron powder, cobalt powder, nickel powder and the like. These magnetic materials may be used in combination of two or more kinds as necessary. Further, as its shape, a magnetic material in spherical shape, octahedron or hexahedron is preferably used. Further, a spherical magnetic material is preferably used in that magnetic powder is uniformly dispersed in the toner. A BET specific surface area of the magnetic powder according to a nitrogen adsorption method is preferably not less than 1 not more than 25 $m^2/g$ and further preferably not less than 2 but not more than 15 $m^2/g$. Further, it is preferable to use magnetic powder having a Mohs hardness of not less than 5 but not more than 7. The average particle diameter of the magnetic material is preferably not less than 0.05 but not more than 0.8 micro-meters and further preferably not less than 0.1 but not more than 0.5 micro-meters. Further, as magnetic properties of the magnetic material, it is preferable that the coercivity is not less than 1 but not more than 15 kA/m by applying 795.8 kA/m, the saturation magnetization is not less than 50 but not more than 200 $Am^2/kg$, and the residual magnetization is not less than 1 but not more than 20 $Am^2/kg$. The amount of the magnetic material added is preferably not less than 4 but not more than 200 mass %, more preferably not less than 10 but not more than 170 mass % and further preferably not less than 20 but not more than 150 mass %, based on 100 mass % of the binder resin.

Meanwhile, the toner for electrophotography of the present invention may be used by partially adding as necessary, for example, polyvinyl chloride, polyvinyl acetate, noncrystalline polyester, crystalline polyester, polyvinyl butyral, polyurethane, polyamide, rosin, polymerized rosin, modified rosin, terpene resin, phenolic resin, aromatic petroleum resin, vinyl chloride resin, styrene-butadiene resin, styrene-ethylene-butadiene-styrene block copolymer, styrene-ethylene-propylene-styrene block copolymer, styrene-(meth)acrylic copolymer, chromane-indene resin, melamine resin or the like, in the ranges in which the effect of the present invention is not hindered.

Surface Treatment Agent

For the toner for electrophotography of the present invention, a surface treatment agent is preferably present between the toner and a carrier, or between toners by adding a surface treatment agent to the surface of the toner. By adding the surface treatment agent, the powder fluidity, storage stability, electrification stability and environmental stability can be improved, and life of a developing agent can also be improved. As a surface treatment agent, conventionally known surface treatment agents can be used, and examples thereof include fine silica powder, fine titanium oxide powder and a hydrophobicity-imparted product thereof. As fine silica powder, there can be used wet silica, dry silica, and a complex of dry silica and metal oxide; and fine silica powder subjected to hydrophobizing treatment with an organic silicon compound or the like can be further used. As the hydrophobizing treatment, for example, a method of treating fine silica powder generated by vapor-phase oxidation of a silicon halogenated compound with a silane compound and with an organic silicon compound can be cited. Examples of the silane compound used for the hydrophobizing treatment include, for example, hexamethyl disilazane, trimethyl silane, trimethyl chlorosilane, trimethyl ethoxysilane, dimethyl dichlorosilane, methyl trichlorosilane, allyldimethyl chlorosilane, allylphenyl dichlorosilane, benzyldimethyl chlorosilane, bromomethyl dimethylchlorosilane, α-chloroethyl trichlorosilane, β-chloroethyl trichlorosilane, chloromethyl dimethylchlorosilane, triorganosilyl mercaptan, trimethylsilyl mercaptan, triorganosilyl acrylate, vinyldimethyl acetoxysilane, dimethyldiethoxy silane, dimethyldimethoxy silane, diphenyldiethoxy silane, hexamethyl disiloxane, 1,3-divinyl tetramethyl disiloxane, 1,3-diphenyl tetramethyl disiloxane and the like. Examples of the organic silicon compound used for the hydrophobizing treatment include, for example, silicone oils such as dimethyl silicone oil, methylphenyl silicone oil, α-methyl styrene-modified silicone oil, chlorophenyl silicone oil, fluorine-modified silicone oil and the like. Further, fine titanium oxide powder subjected to oil treatment and fine particle of a vinyl resin of not less than 0.03 but not more than 1 micro-meter can also be used. As the surface treatment agent in addition thereto, there can also be used a lubricant such as polyethylene fluoride, zinc stearate and polyvinylidene fluoride; an abrasive such as cerium oxide, silicon carbide, strontium titanate, magnetic powder, alumina and the like; and a conductive grant agent such as carbon black, zinc oxide, antimony oxide, tin oxide and the like. As the shape of the surface treatment agent, there can be used various shapes such as a particle having a small particle diameter of not more than 100 nano-meters, a particle having a large particle diameter of not less than 100 nano-meters, octahedron shape, hexahedron shape, needle shape, fiber shape and the like. The surface treatment agents may be used singly or in combination of two or more kinds. The amount of the surface treatment agent added is, for example, suitably not less than 0.1 but not more than 10 mass parts and further suitably not less than 0.1 but not more than 5 mass parts in 100 mass parts of the toner.

Carrier

When the toner for electrophotography of the present invention is used as a two-component developing agent, conventionally known carriers can be used as a carrier. For example, there can be used particles having an average particle diameter of not less than 20 but not more than 300 micro-meters composed of metals such as surface-oxidated or non-oxidated iron, cobalt, manganese, chromium and rare earths, and an alloy thereof or oxides. As the carriers, there can be used carriers with its surface coated by a styrene resin, an acrylic resin, a silicon resin, a polyester resin, a fluorine resin or the like.

The resulting toner according to the present invention can be applied to various conventionally known development methods, for example, a cascade development method, a magnetic brush development method, a powder cloud development method, a touch-down development method, a so-called micro-toning development method using, as a carrier, a magnetic toner produced by grinding, and a so-called bipolar magnetic toner development method in which a required amount of toner charges are obtained by the friction between magnetic toners. The development methods are not restricted thereto. The resulting toner according to the present invention can also be applied to various cleaning methods such as a conventionally known fur brush method, a blade method and the like. Further, the resulting toner according to the present invention can be applied to various conventionally known fixing methods. Concrete examples thereof include an oil-free heat roll fixing method, an oil-coated heat roll fixing method, a thermal belt fixing method, a flash fixing method, an oven fixing method, a pressure fixing method and the like. It can also be applied to a fixing apparatus using an electromagnetic induction heating method. Further, it can also be applied to an image forming method involving an intermediate transfer step.

EXAMPLES

The present invention is now illustrated in detail below with reference to Examples and Comparative Examples. Furthermore, methods of measuring and judging data are as follows:

Acid Value

The acid value in the Example was calculated in the following manner. An accurately weighed sample was dissolved in a mixed solvent of xylene and n-butanol (mass ratio=1:1). It was titrated with N/10 potassium hydroxide, prepared in advance by adding 7 g of potassium hydroxide (special class) to 5 g of ion exchange water, pouring ethyl alcohol (first class) to obtain 1 L of solution, then titrating with N/10 hydrochloric acid and 1% phenolphthalein solution to obtain the titer:F, then its titration amount was used to calculate the acid value according to the following equation.

$$\text{Acid value (mgKOH/g)}=(N/10\ \text{KOH titration amount (ml)}\times F\times 5.61)/(\text{sample (g)}\times 0.01)$$

Peak Molecular Weight

The peak molecular weight in the Example was obtained by GPC (gel permeation chromatography) method, and is a molecular weight calculated with reference to a calibration curve produced by the use of the monodispersed standard polystyrene. Furthermore, the peak in the Example also contains a shoulder peak. The measurement conditions are as follows. The insoluble component in THF was removed from the sample solution by means of a filter right before the measurement.

GPC apparatus: SHODEX GPC SYSTEM-21 (Showa Denko K.K.)

Detector: SHODEX RI SE-31 (Showa Denko K.K.)

Column: SHODEX GPC KF-807L×3+GPC KF-800D×1 (Showa Denko K.K.)

Solvent: THF

Flow rate: 1.2 ml/min.

Sample concentration: 0.002 g-resin/ml-THF

Injected amount: 100 μL

To measure the molecular weight of a toner, 10 mass % of the toner was fully dissolved in 90 mass % of THF, and then 50 mass parts of SIMGON talc and 50 mass parts of titanium (CR-95) were added thereto for carrying out centrifugation. The resulting supernatant liquid was adjusted to a prescribed concentration for measuring the molecular weight.

THF Insoluble Content

The THF insoluble content of the binder resin in the Example was obtained in the following manner. 0.4 g of a resin and 39.5 g of THF were fed into a 50-mL lidded glass sample tube, and this sample tube was stirred under conditions of a rotation speed of 50 rpm and a temperature of 22 degrees centigrade for 48 hours, and then allowed to stand at 22 degrees centigrade for 24 hours. Thereafter, 5 g of the supernatant liquid in the sample tube was dried at 150 degrees centigrade for 1 hour and then its weight was measured, and this weight was taken as Xg to calculate the THF insoluble content (mass %) according to the following equation.

$$THF \text{ insoluble contest (Mass \%)} = \frac{(0.4/(0.4+39.5)) - X/5}{0.4/(0.4+39.5)} \times 100$$

The THF insoluble content of the toner in the Example was obtained in the following manner. 1.0 g of a resin was weighed, put into an extraction thimble, placed in a Soxhlet extractor, and extracted with 200 ml of THF for 12 hours. The extracted soluble content was evaporated, and then the resulting soluble content was vacuum-dried at 100 degrees centigrade for 6 hours. Then, the amount of THF soluble content was measured and its weight was taken as Xg. The amount of the component other than the resin in the toner was taken as Yg and the THF insoluble content (mass %) was calculated according to the following equation.

$$THF \text{ insoluble content (Mass \%)} = \frac{1.0 - (X+Y)}{1.0 - Y} \times 100$$

Glass Transition Temperature (Tg)

Tg in the Example was measured using DSC-20 (a product of Seiko Instruments Inc.) according to differential scanning calorimetry (DSC). About 10 mg of a sample was subjected to temperature elevation from −20 to 200 degrees centigrade at a rate of 10 degrees centigrade/min to obtain a curve; in the curve, an intersection between the base line and the inclined line of the endothermic peak was determined; and the Tg of the sample was determined from the intersection.

Epoxy Value

For the epoxy value, 0.2 g to 5 g of a resin sample was weighed accurately and put into a 200-mL Erlenmeyer flask, and then 25 mL of dioxane was added thereto and dissolved therein. 25 mL of a 1/5 normal hydrochloric acid solution (dioxane solvent) was added, and the resulting solution was sealed and fully mixed, and then allowed to stand for 30 minutes. Next, 50 mL of a mixed solution of toluene and ethanol (1:1 volume ratio) was added, and then the reaction solution was titrated with a 1/10 normal aqueous sodium hydroxide solution using cresol red as an indicator. Based on the titration results, the epoxy value (Eq/100 g) was calculated according to the following equation.

$$\text{Epoxy value (Eq/100 g)} = [(B-S)\times N\times F]/(10\times W)$$

Herein, W refers to the amount of collected sample (g), B refers to the amount of the aqueous sodium hydroxide solution (ml) required for a blank test, S refers to the amount of the aqueous sodium hydroxide solution (ml) required for the test of the sample, N refers to the normality of the aqueous sodium hydroxide solution, and F refers to the titer of the aqueous sodium hydroxide solution.

Measurement of Viscoelasticity

The viscoelasticity in the Example was determined according to the following measurement. Viscoelasticity apparatus: STRESS TECH Rheometer (a product of ReoLogica Instruments)

Measurement mode: Oscillation strain control

Measurement temperature range: 50 to 200 degrees centigrade

Temperature elevation rate: 2 degrees centigrade/min.

Frequency: 1 Hz (6.28 rad/s)

Gap: 1 mm

Plate: Parallel plates

Stress strain: 1%

Sample shape: Cylindrical shape having a thickness of 1 mm and a diameter of about 20 mm Next, the evaluation method of a toner in this invention is described as follows.

1. Fixing Properties

An unfixed image was formed using a copier produced by remodeling a commercial electrophotographic copier. The unfixed image was fixed using a heat roller fixing apparatus produced by remodeling the fixing section of a commercial copier at a fixing speed of the heat roller of 190 mm/sec at a temperature of 150, 160 and 170 degrees centigrade. The fixed image obtained was rubbed 6 times by applying a load of 1.0 kgf using a sand eraser (a product of Tombow Pencil Co., Ltd.), and the image densities before and after the rubbing test were measured using a Macbeth reflection densitometer. The image density after the rubbing test÷image density before the rubbing test×100 was taken as the change ratio at its temperature. The average value of the change ratios at 150, 160 and 170 degrees centigrade was calculated as a fixing ratio which was then determined on the basis of the following evaluation standard. Incidentally, the heat roller fixing apparatus used herein had no silicon oil feeder. The environmental conditions were under normal temperature and normal pressure (temperature=22 degrees centigrade, relative humidity=55%).

(Evaluation Standard)

○: 67%≤Fixing ratio

Δ: 63%<Fixing ratio <67% x: Fixing ratio ≤63%

2. Offset Resistance

The offset resistance was evaluated as follows according to the above measurement of the lowest fixing temperature. After an unfixed image was formed using the above copier; the toner image was transferred and fixed using the above heat roller fixing apparatus. Then, the appearance of toner staining on the non-image portion was examined visually. This operation was repeated by gradually increasing the set temperature of the heat roller of the heat roller fixing apparatus. The lowest set temperature at which toner staining appeared on the transfer paper was taken as the temperature of offset appearance.

The atmosphere of the above copier was a temperature of 22 degrees centigrade and a relative humidity of 55%.

(Evaluation Standard)

○: 230 degrees centigrade ≤Temperature of offset appearance

Δ: 220 degrees centigrade ≤Temperature of offset appearance <230 degrees centigrade x: Temperature of offset appearance <220 degrees centigrade 3. Cleaning Properties After continuous copying of 20,000 copies was conducted at a temperature of 22 degrees centigrade and a relative humidity of 55% using the above copier, contamination of a photo-sensitive material was evaluated visually.

(Evaluation Standard)

○: Not contaminated at all.

x: Contamination confirmed.

4. Storage Stability

The toner was allowed to stand under the environmental conditions of a temperature of 50 degrees centigrade and a relative humidity of 60% for 24 hours, and 5 g thereof was fed into a sieve of 150 mesh. Then, the scale of a rheostat of a powder tester (Hosokawa Powder Technology Research Institute) was set to 3 for vibrating it for a minute. After vibration, the mass remained on the sieve of 150 mesh was measured to determine the residual mass ratio.

(Evaluation Standard)

○: Residual mass ratio <25%

Δ: 25%≤Residual mass ratio <30% x: 30%≤Residual mass ratio

5. Durability

To a 10-ml glass sample tube was fed 24 g of a stainless steel ball, and 0.05 g of a toner was added thereto. The resulting material was lidded, and stirred while rotating at a rate of 300 rpm for 20 minutes. The particle size distributions of the toner before and after stirring were measured by the use of a coulter counter. (number median diameter D50 before stirring−number median diameter D50 after stirring)÷number median diameter D50 before stirring×100 was taken as the particle diameter change ratio which was then determined according to the following standard.

(Evaluation Standard)

○: Particle diameter change ratio ≤21%

Δ: 21%<Particle diameter change ratio ≤23% x: 23%<Particle diameter change ratio

6. Productivity

In the production of a toner, the mixture kneaded using a twin screw kneader and cooled was partially collected and ground, arranged at 10 mesh under and 16 mesh on particle size, and ground under prescribed conditions using a jet mill to measure the toner yield. The particle size distribution was measured using a coulter counter, and (yield g of the toner per unit hour)÷(weight g of the toner particle obtained from volume median diameter D50)÷$10^{10}$ was taken as the productivity which was then determined according to the following standard.

○: 100≤Productivity

Δ: 95 V Productivity <100 x: Productivity <95

Production Example of a Glycidyl Group-Containing Vinyl Resin (E)

Production Example E-1

50 parts of xylene was fed into a flask purged with nitrogen and the resulting material was heated. Under xylene reflux, a mixed solution obtained by previously mixing 0.5 mass parts of di-t-butylperoxide with 100 mass parts of the monomer as described in Table 1 for dissolving was continuously added over 5 hours, and further continuously refluxed for 1 hour. Thereafter, while an internal temperature was maintained at 130 degrees centigrade, 0.5 mass parts of di-t-butylperoxide was added and the reaction was continued for 2 hours to obtain a polymerization solution. The resulting polymerization solution was flashed in a vessel of 1.33 kPa at 160 degrees centigrade for removing a solvent or the like to obtain a resin E-1. Its physical properties are shown in Table 1.

Production Example E-2

50 parts of xylene was fed into a flask purged with nitrogen and the resulting material was heated. Under xylene reflux, a mixed solution obtained by previously mixing 0.4 mass parts of di-t-butylperoxide with 100 mass parts of the monomer as described in Table 1 for dissolving was continuously added over 5 hours, and further continuously refluxed for 1 hour. Thereafter, while an internal temperature was maintained at 130 degrees centigrade, 0.5 mass parts of di-t-butylperoxide was added and the reaction was continued for 2 hours to obtain a polymerization solution. The resulting polymerization solution was flashed in a vessel of 1.33 kPa at 160 degrees centigrade for removing a solvent or the like to obtain a resin E-2. Its physical properties are shown in Table 1.

Production Example E-3

A resin E-3 was obtained in the same manner as in Production Example E-1. Its physical properties are shown in Table 1.

Production Example E-4

50 parts of xylene was fed into a flask purged with nitrogen and the resulting material was heated. Under xylene reflux, a mixed solution obtained by previously mixing 1.2 mass parts of di-t-butylperoxide with 100 mass parts of the monomer as described in Table 1 for dissolving was continuously added over 5 hours, and further continuously refluxed for 1 hour. Thereafter, while an internal temperature was maintained at 130 degrees centigrade, 0.5 mass parts of di-t-butylperoxide was added and the reaction was continued for 2 hours to obtain a polymerization solution. The resulting polymerization solution was flashed in a vessel of 1.33 kPa at 160 degrees centigrade for removing a solvent or the like to obtain a resin E-4. Its physical properties are shown in Table 1.

Production Example E-5

A resin E-5 was obtained in the same manner as in Production Example E-1. Its physical properties are shown in Table 1.

TABLE 1

| | Composition (mass parts) | | | Physical properties | |
|---|---|---|---|---|---|
| | Styrene | Butyl acrylate | Glycidyl methacrylate | Peak molecular weight — | Epoxy value Eq/100 g |
| E-1 | 77.0 | 20.0 | 3.0 | 51,000 | 0.021 |
| E-2 | 78.5 | 21.0 | 0.5 | 58,000 | 0.004 |
| E-3 | 70.0 | 20.0 | 10.0 | 47,000 | 0.070 |

TABLE 1-continued

| | Composition (mass parts) | | | Physical properties | |
|---|---|---|---|---|---|
| | Styrene | Butyl acrylate | Glycidyl methacrylate | Peak molecular weight — | Epoxy value Eq/100 g |
| E-4 | 77.5 | 21.5 | 1.0 | 31,000 | 0.007 |
| E-5 | 78.8 | 21.0 | 0.2 | 50,000 | 0.001 |

Production Example of a Low Molecular Weight Vinyl Resin (L)

Production Example L-1

100 mass parts of xylene was fed into a flask purged with nitrogen and the resulting material was heated. Under xylene reflux, a mixed solution obtained by previously mixing 10 mass parts of t-butylperoxy-2-ethylhexanoate with 100 mass parts of the monomer as described in Table 1 for dissolving was continuously added over 5 hours, and further continuously refluxed for 1 hour. Thereafter, while an internal temperature was maintained at 98 degrees centigrade, 0.5 mass parts of t-butylperoxy-2-ethylhexanoate was added and the reaction was continued for 1 hour, and 0.5 mass parts of t-butylperoxy-2-ethylhexanoate was further added and the reaction was continued for 2 hours to obtain a polymerization solution of L-1. The physical properties are shown in Table 2.

Production Example L-2

A polymerization solution of L-2 was obtained in the same manner as in Production Example L-1.

Production Example L-3

184 mass parts of xylene was fed into a flask purged with nitrogen and the resulting material was heated. Under xylene reflux, a mixed solution obtained by previously mixing 15 mass parts of t-butylperoxy-2-ethylhexanoate with 100 mass parts of the monomer as described in Table 1 for dissolving was continuously added over 7 hours, and further continuously refluxed for 1 hour. Thereafter, while an internal temperature was maintained at 98 degrees centigrade, 0.5 mass parts of t-butylperoxy-2-ethylhexanoate was added and the reaction was continued for 1 hour, and 0.5 mass parts of t-butylperoxy-2-ethylhexanoate was further added and the reaction was continued for 2 hours to obtain a polymerization solution of L-3. The physical properties are shown in Table 2.

Production Examples L-4 to L-6

With compositions as illustrated in Table 2, polymerization solutions of L-4 to L-6 were obtained in the same manner as in Production Example L-1.

Production Example L-7

75 mass parts of xylene was fed into a flask purged with nitrogen and the resulting material was heated. Under xylene reflux, a mixed solution obtained by previously mixing 12 mass parts of t-butylperoxy-2-ethylhexanoate with 100 mass parts of the monomer as described in Table 1 for dissolving was continuously added over 5 hours, and further continuously refluxed for 1 hour. Thereafter, while an internal temperature was maintained at 98 degrees centigrade, 0.3 mass parts of t-butylperoxy-2-ethylhexanoate was added and the reaction was continued for 1 hour, and 0.5 mass parts of t-butylperoxy-2-ethylhexanoate was further added and the reaction was continued for 2 hours to obtain a polymerization solution of L-7. The physical properties are shown in Table 2.

Production Example L-8

75 mass parts of xylene was fed into a flask purged with nitrogen and the resulting material was heated. Under xylene reflux, a mixed solution obtained by previously mixing 5 mass parts of t-butylperoxy-2-ethylhexanoate with 100 mass parts of the monomer as described in Table 1 for dissolving was continuously added over 5 hours, and further continuously refluxed for 1 hour. Thereafter, while an internal temperature was maintained at 98 degrees centigrade, 0.5 mass parts of t-butylperoxy-2-ethylhexanoate was added and the reaction was continued for 1 hour, and 0.5 mass parts of t-butylperoxy-2-ethylhexanoate was further added and the reaction was continued for 2 hours to obtain a polymerization solution of L-8. The physical properties are shown in Table 2.

Production Example L-9

75 mass parts of xylene was fed into a flask purged with nitrogen and the resulting material was heated. Under xylene reflux, a mixed solution obtained by previously mixing 2.5 mass parts of t-butylperoxy-2-ethylhexanoate with 100 mass parts of the monomer as described in Table 1 for dissolving was continuously added over 5 hours, and further continuously refluxed for 1 hour. Thereafter, while an internal temperature was maintained at 98 degrees centigrade, 0.5 mass parts of t-butylperoxy-2-ethylhexanoate was added and the reaction was continued for 1 hour, and 0.5 mass parts of t-butylperoxy-2-ethylhexanoate was further added and the reaction was continued for 2 hours to obtain a polymerization solution of L-9. The physical properties are shown in Table 2.

TABLE 2

| Name of resin | Composition (mass part) | | | | | Physical properties | |
|---|---|---|---|---|---|---|---|
| | Styrene | Butyl acrylate | Butyl methacrylate | Methacrylic acid | S/A | Peak molecular weight | Acid value AVL (mgKOH/g) |
| L-1 | 93.0 | 6.0 | 0.0 | 1.0 | 13.29 | 4600 | 6.5 |
| L-2 | 93.0 | 4.7 | 0.0 | 2.3 | 13.29 | 4500 | 15.0 |
| L-3 | 95.8 | 3.2 | 0.0 | 1.0 | 22.81 | 2400 | 6.5 |
| L-4 | 93.0 | 6.5 | 0.0 | 0.5 | 13.29 | 4600 | 3.3 |
| L-5 | 90.0 | 6.0 | 3.0 | 1.0 | 9.00 | 4700 | 6.5 |
| L-6 | 88.0 | 8.0 | 0.0 | 4.0 | 7.33 | 4600 | 26.0 |
| L-7 | 99.9 | 0.0 | 0.0 | 0.1 | 999.00 | 4000 | 0.7 |

TABLE 2-continued

| Name of resin | Composition (mass part) Styrene | Butyl acrylate | Butyl methacrylate | Methacrylic acid | S/A | Physical properties Peak molecular weight | Acid value AVL (mgKOH/g) |
|---|---|---|---|---|---|---|---|
| L-8 | 84.5 | 14.5 | 0.0 | 1.0 | 5.45 | 7400 | 6.5 |
| L-9 | 78.5 | 20.5 | 0.0 | 1.0 | 3.65 | 13500 | 6.5 |

Production Example of a High Molecular Weight Vinyl Resin (H)

Production Example H-1

100 mass parts of the monomer as described in Table 1 was fed into a flask purged with nitrogen. The resulting material was heated to an internal temperature of 120 degrees centigrade and then kept at the same temperature for carrying out bulk polymerization for 8 hours. Subsequently, 50 parts of xylene was added and 0.2 mass parts of tetraethylene glycol diacrylate was added thereto, and then the mixture was heated to 110 degrees centigrade. While 0.35 parts of 1,1-bis(t-butylperoxy)cyclohexane and 60 parts of xylene previously mixed and dissolved were kept at a temperature of 110 degrees centigrade, the mixture was continuously added over 9 hours and then the reaction was continued for 1 hour. 0.21 mass parts of 1,1-bis(t-butylperoxy)cyclohexane was added and the reaction was continued for 2 hours, and 0.52 mass parts of 1,1-bis(t-butylperoxy)cyclohexane was further added and the reaction was continued for 2 hours to complete polymerization, whereby a high molecular weight polymerization solution H-1 was obtained. The physical properties are shown in Table 3.

Production Example H-2

100 mass parts of the monomer as described in Table 1 was fed into a flask purged with nitrogen. The resulting material was heated to an internal temperature of 128 degrees centigrade and then kept at the same temperature for carrying out bulk polymerization for 3 hours. Subsequently, 50 parts of xylene was added thereto and then the mixture was heated to 110 degrees centigrade. While 0.35 parts of 1,1-bis(t-butylperoxy)cyclohexane and 60 parts of xylene previously mixed and dissolved were kept at a temperature of 110 degrees centigrade, the mixture was continuously added over 9 hours and then the reaction was continued for 1 hour. 0.21 mass parts of 1,1-bis(t-butylperoxy)cyclohexane was added and the reaction was continued for 2 hours, and 0.52 mass parts of 1,1-bis(t-butylperoxy)cyclohexane was further added and the reaction was continued for 2 hours to complete polymerization, whereby a high molecular weight polymerization solution H-2 was obtained. The physical properties are shown in Table 3.

Production Examples H-3 to H-6

With compositions as illustrated in Table 3, high molecular weight polymerization solutions of H-3 to H-6 were obtained in the same manner as in Production Example H-1.

Production Example H-7

100 mass parts of the monomer as described in Table 1 was fed into a flask purged with nitrogen. The resulting material was heated to an internal temperature of 120 degrees centigrade and then kept at the same temperature for carrying out bulk polymerization for 1.5 hours. Subsequently, 50 parts of xylene was added thereto and then the mixture was heated to 130 degrees centigrade. While 0.3 parts of di-t-butylperoxide and 60 parts of xylene previously mixed and dissolved were kept at a temperature of 130 degrees centigrade, the mixture was continuously added over 4 hours and then the reaction was continued for 1 hour. 0.2 mass parts of di-t-butylperoxide was added and the reaction was continued for 2 hours, and 0.2 mass parts of di-t-butylperoxide was further added and the reaction was continued for 2 hours to complete polymerization, whereby a high molecular weight polymerization solution H-7 was obtained. The physical properties are shown in Table 3.

Production Examples H-8 to H-11

With compositions as illustrated in Table 3, high molecular weight polymerization solutions of H-8 to H-11 were obtained in the same manner as in Production Example H-1.

TABLE 3

| Name of resin | Composition (mass part) Styrene | Butyl acrylate | Butyl methacrylate | Methacrylic acid | S/A | Physical properties Peak molecular weight | Acid value AVH (mgKOH/g) |
|---|---|---|---|---|---|---|---|
| H-1 | 74.0 | 23.5 | 0.0 | 2.5 | 2.85 | 300000 | 16.3 |
| H-2 | 74.0 | 23.5 | 0.0 | 2.5 | 2.85 | 170000 | 16.3 |
| H-3 | 81.0 | 16.5 | 0.0 | 2.5 | 4.26 | 320000 | 16.3 |
| H-4 | 67.0 | 20.5 | 10.0 | 2.5 | 2.03 | 290000 | 16.3 |
| H-5 | 72.0 | 23.5 | 0.0 | 4.5 | 2.57 | 300000 | 29.3 |
| H-6 | 74.3 | 24.5 | 0.0 | 1.2 | 2.89 | 160000 | 7.8 |
| H-7 | 73.0 | 24.5 | 0.0 | 2.5 | 2.70 | 140000 | 16.3 |
| H-8 | 87.0 | 10.5 | 0.0 | 2.5 | 6.69 | 310000 | 16.3 |
| H-9 | 63.0 | 24.5 | 10.0 | 2.5 | 1.70 | 300000 | 16.3 |
| H-10 | 70.0 | 23.5 | 0.0 | 6.5 | 2.33 | 280000 | 42.3 |
| H-11 | 76.4 | 23.5 | 0.0 | 0.1 | 3.24 | 300000 | 0.7 |

Production Example of a Carboxyl Group-Containing Vinyl Resin (C)

Production Examples C-1 to C-25

Each polymerization solution was mixed such that the mass ratio of a high molecular weight vinyl resin (H) to a low molecular weight vinyl resin (L) was the ratio as described in Table 4, and the mixture was flashed in a vessel of 1.33 kPa at 190 degrees centigrade for removing a solvent or the like to obtain resins C-1 to C-25. The physical properties are shown in Table 4.

TABLE 4

| Name of resin | Raw material resin: High molecular weight vinyl resin | Raw material resin: Low molecular weight vinyl resin | Ratio (mass %) (H) | Ratio (mass %) (L) | AV (mgKOH/g) | AVH and AVL compared |
|---|---|---|---|---|---|---|
| C-1 | H-1 | L-1 | 40 | 60 | 10.4 | AVH > AVL |
| C-2 | H-1 | L-1 | 50 | 50 | 11.4 | AVH > AVL |
| C-3 | H-1 | L-1 | 30 | 70 | 9.4 | AVH > AVL |
| C-4 | H-2 | L-1 | 40 | 60 | 10.4 | AVH > AVL |
| C-5 | H-3 | L-1 | 40 | 60 | 10.4 | AVH > AVL |
| C-6 | H-4 | L-1 | 40 | 60 | 10.4 | AVH > AVL |
| C-7 | H-5 | L-1 | 40 | 60 | 15.6 | AVH > AVL |
| C-8 | H-6 | L-1 | 40 | 60 | 7.0 | AVH > AVL |
| C-9 | H-1 | L-2 | 40 | 60 | 15.5 | AVH > AVL |
| C-10 | H-1 | L-3 | 40 | 60 | 10.4 | AVH > AVL |
| C-11 | H-1 | L-4 | 40 | 60 | 8.5 | AVH > AVL |
| C-12 | H-1 | L-5 | 40 | 60 | 10.4 | AVH > AVL |
| C-13 | H-3 | L-3 | 40 | 60 | 10.4 | AVH > AVL |
| C-14 | H-1 | L-6 | 40 | 60 | 22.1 | AVL > AVH |
| C-15 | H-3 | L-7 | 40 | 60 | 6.9 | AVH > AVL |
| C-16 | H-1 | L-8 | 40 | 60 | 10.4 | AVH > AVL |
| C-17 | H-1 | L-9 | 30 | 70 | 9.4 | AVH > AVL |
| C-18 | H-7 | L-1 | 40 | 60 | 10.4 | AVH > AVL |
| C-19 | H-8 | L-1 | 40 | 60 | 10.4 | AVH > AVL |
| C-20 | H-9 | L-1 | 40 | 60 | 10.4 | AVH > AVL |
| C-21 | H-10 | L-1 | 40 | 60 | 20.8 | AVH > AVL |
| C-22 | H-11 | L-1 | 40 | 60 | 4.2 | AVL > AVH |
| C-23 | H-8 | L-3 | 40 | 60 | 10.4 | AVH > AVL |
| C-24 | H-1 | L-1 | 20 | 80 | 8.5 | AVH > AVL |
| C-25 | H-1 | L-1 | 60 | 40 | 12.4 | AVH > AVL |

Production Example of a Binder Resin (R)

Production Examples R-1 to R-34

Each resin was mixed such that the mass ratio of a carboxyl group-containing vinyl resin (C) to a glycidyl group-containing vinyl resin (E) was the ratio as described in Table 5, and then the mixture was kneaded and reacted for the residence time of 90 seconds by the use of a twin screw kneader (KEXN S-40 type, a product of Kurimoto Ltd.) with its temperature set to the reaction temperature as described in Table 5. Thereafter, the reaction mixture was cooled and ground to obtain binder resins R-1 to R-34. The physical properties are shown in Table 5. As a method for cooling, a steel belt cooler was used under conditions of the cooling water temperature of 10 degrees centigrade and the amount of cooling water of 20 liter per 1 Kg of a resin. Cooling was rapidly carried out by using a steel belt cooler (NR3-Hi double cooler, a product of Nippon Belting Co., Ltd.) under conditions of the cooling water temperature of 10 degrees centigrade, the cooling rate of 90 L/min and the belt speed of 6 m/min. The physical properties are shown in Table 5.

TABLE 5

| Name of resin | Raw material resin: Carboxyl group-containing vinyl resin (C) | Raw material resin: Glycidyl group-containing resin (E) | Resin ratio (C) Mass % | Resin ratio (E) Mass % | S/A | Reaction temp. (° C.) | Physical properties: Molecular weight First peak | Physical properties: Molecular weight Second peak | Physical properties: THF insoluble content Mass % |
|---|---|---|---|---|---|---|---|---|---|
| R-1 | C-1 | E-1 | 93 | 7 | 5.58 | 170 | 4600 | 180000 | 8.2 |
| R-2 | C-1 | E-1 | 93 | 7 | 5.58 | 150 | 4600 | 235000 | 1.9 |
| R-3 | C-1 | E-1 | 93 | 7 | 5.58 | 190 | 4600 | 160000 | 15.5 |
| R-4 | C-2 | E-1 | 93 | 7 | 4.90 | 170 | 4600 | 215000 | 14.0 |
| R-5 | C-3 | E-1 | 93 | 7 | 6.45 | 170 | 4600 | 160000 | 3.6 |
| R-6 | C-4 | E-1 | 93 | 7 | 5.58 | 170 | 4600 | 164000 | 2.6 |
| R-7 | C-5 | E-1 | 93 | 7 | 6.95 | 170 | 4600 | 195000 | 8.2 |
| R-8 | C-6 | E-1 | 93 | 7 | 4.62 | 170 | 4600 | 180000 | 7.8 |
| R-9 | C-7 | E-1 | 93 | 7 | 5.28 | 170 | 4600 | 170000 | 12.0 |
| R-10 | C-8 | E-1 | 93 | 7 | 5.63 | 210 | 4600 | 153000 | 2.3 |
| R-11 | C-9 | E-1 | 93 | 7 | 5.58 | 170 | 4700 | 246000 | 1.2 |
| R-12 | C-10 | E-1 | 93 | 7 | 6.34 | 170 | 2400 | 180000 | 7.9 |
| R-13 | C-11 | E-1 | 93 | 7 | 5.58 | 170 | 4600 | 180000 | 8.1 |
| R-14 | C-12 | E-1 | 93 | 7 | 4.93 | 170 | 4700 | 180000 | 7.8 |
| R-15 | C-1 | E-1 | 98 | 2 | 5.77 | 190 | 4600 | 173000 | 8.3 |
| R-16 | C-1 | E-1 | 89 | 11 | 5.44 | 150 | 4500 | 179000 | 8.4 |
| R-17 | C-1 | E-2 | 93 | 7 | 5.63 | 170 | 4600 | 240000 | 1.8 |
| R-18 | C-1 | E-3 | 93 | 7 | 5.38 | 170 | 4600 | 158000 | 16.8 |
| R-19 | C-1 | E-4 | 93 | 7 | 5.60 | 170 | 4600 | 230000 | 1.9 |
| R-20 | C-13 | E-1 | 93 | 7 | 8.07 | 170 | 2400 | 198000 | 8.5 |
| R-21 | C-14 | E-1 | 93 | 7 | 4.56 | 170 | 4900 | 256000 | 0.5 |
| R-22 | C-15 | E-1 | 93 | 7 | 10.45 | 170 | 4000 | 182000 | 8.0 |

TABLE 5-continued

| Name of resin | Raw material resin: Carboxyl group-containing vinyl resin (C) | Raw material resin: Glycidyl group-containing resin (E) | Resin ratio (C) Mass % | Resin ratio (E) Mass % | S/A | Reaction temp. (° C.) | Physical properties: Molecular weight First peak | Physical properties: Molecular weight Second peak | Physical properties: THF insoluble content Mass % |
|---|---|---|---|---|---|---|---|---|---|
| R-23 | C-16 | E-1 | 93 | 7 | 4.02 | 170 | 7400 | 210000 | 8.0 |
| R-24 | C-17 | E-1 | 93 | 7 | 3.37 | 170 | 13500 | N/A | 15.0 |
| R-25 | C-18 | E-1 | 93 | 7 | 5.43 | 170 | 4600 | 130000 | 4.1 |
| R-26 | C-19 | E-1 | 93 | 7 | 8.66 | 170 | 4600 | 190000 | 7.8 |
| R-27 | C-20 | E-1 | 93 | 7 | 4.19 | 170 | 4600 | 180000 | 8.3 |
| R-28 | C-21 | E-1 | 93 | 7 | 5.00 | 170 | 4600 | 148000 | 15.5 |
| R-29 | C-22 | E-1 | 93 | 7 | 6.00 | 170 | 4600 | 295000 | 0.2 |
| R-30 | C-23 | E-1 | 93 | 7 | 10.38 | 170 | 2400 | 190000 | 8.3 |
| R-31 | C-24 | E-1 | 93 | 7 | 7.58 | 170 | 4600 | 180000 | 1.8 |
| R-32 | C-25 | E-1 | 93 | 7 | 4.34 | 170 | 4600 | 240000 | 25.0 |
| R-33 | C-1 | E-5 | 93 | 7 | 5.64 | 170 | 4600 | 280000 | 0.2 |
| R-34 | C-1 | N/A | 100 | 0 | 5.85 | 170 | 4600 | 290000 | 0.0 |

Production Example of a Toner for Electrophotography (T)

Production Examples T-1 to T-34

6 mass parts of carbon black (MA100, a product of Mitsubishi Kasei Kogyo K.K.), 2.5 mass parts of polypropylene wax (Hi-wax NP105, a product of Mitsui Chemicals Inc., Ltd.) and 0.5 mass parts of a charge controlling agent (T-77, a product of Hodogaya Chemical Co., Ltd.) were added to 100 mass parts of the binder resin (R) as illustrated in Table 5. The resulting mixture was mixed by using a Henschel mixer, and then kneaded in a twin screw kneader (PCM-30 type, a product of Ikegai Corporation) at 120 degrees centigrade of the resin temperature at the discharge portion of the twin screw kneader for the residence time of 30 seconds. Next, after cooling, grinding and dispensing, toners T-1 to T-34 having a particle diameter of about 7 micro-meters were obtained. The physical properties are shown in Table 6.

TABLE 6

| Toner | Resin | S/A | Physical properties: Molecular weight 1st peak | Molecular weight 2nd peak | THF insoluble content Mass % | Tg ° C. | G' (155° C.) ×1000 Pa | G'' (155° C.) ×1000 Pa | G' (165° C.) ×1000 Pa | G'' (165° C.) ×1000 Pa | G' (165° C.)/G' (155° C.) — | G'' (165° C.)/G'' (155° C.) — |
|---|---|---|---|---|---|---|---|---|---|---|---|---|
| T-1 | R-1 | 5.58 | 4600 | 139000 | 12.3 | 59 | 8.23 | 4.16 | 7.47 | 3.07 | 0.91 | 0.74 |
| T-2 | R-2 | 5.58 | 4600 | 156000 | 5.3 | 59 | 6.18 | 3.99 | 5.61 | 2.98 | 0.91 | 0.75 |
| T-3 | R-3 | 5.58 | 4600 | 111000 | 25.1 | 59 | 9.92 | 4.64 | 8.99 | 3.43 | 0.91 | 0.74 |
| T-4 | R-4 | 4.90 | 4600 | 162000 | 22.5 | 59 | 12.50 | 9.56 | 12.25 | 7.25 | 0.98 | 0.76 |
| T-5 | R-5 | 6.45 | 4600 | 105000 | 4.8 | 59 | 3.69 | 2.48 | 3.12 | 1.75 | 0.85 | 0.71 |
| T-6 | R-6 | 5.58 | 4600 | 140000 | 3.6 | 58 | 4.85 | 3.47 | 4.42 | 2.45 | 0.91 | 0.71 |
| T-7 | R-7 | 6.95 | 4600 | 135000 | 14.5 | 63 | 8.61 | 5.12 | 8.03 | 3.63 | 0.93 | 0.71 |
| T-8 | R-8 | 4.62 | 4600 | 138000 | 13.6 | 57 | 8.16 | 4.41 | 8.01 | 3.21 | 0.98 | 0.73 |
| T-9 | R-9 | 5.28 | 4600 | 110000 | 19.6 | 60 | 10.30 | 5.10 | 10.10 | 3.61 | 0.98 | 0.71 |
| T-10 | R-10 | 5.63 | 4600 | 143000 | 3.2 | 57 | 3.69 | 4.03 | 3.51 | 2.84 | 0.95 | 0.70 |
| T-11 | R-11 | 5.58 | 4900 | 189000 | 2.3 | 61 | 5.90 | 4.20 | 5.00 | 3.10 | 0.85 | 0.74 |
| T-12 | R-12 | 6.34 | 2400 | 135000 | 13.8 | 61 | 5.90 | 3.70 | 5.50 | 2.70 | 0.93 | 0.73 |
| T-13 | R-13 | 5.58 | 4600 | 132000 | 14.2 | 58 | 8.30 | 4.00 | 7.60 | 2.80 | 0.92 | 0.70 |
| T-14 | R-14 | 4.93 | 4700 | 139000 | 13.6 | 57 | 8.03 | 3.90 | 7.36 | 2.89 | 0.92 | 0.74 |
| T-15 | R-15 | 5.77 | 4600 | 156000 | 9.2 | 59 | 5.70 | 3.90 | 5.60 | 2.80 | 0.98 | 0.72 |
| T-16 | R-16 | 5.44 | 4500 | 137000 | 18.8 | 59 | 8.40 | 4.30 | 7.80 | 3.20 | 0.93 | 0.74 |
| T-17 | R-17 | 5.63 | 4600 | 187000 | 2.1 | 59 | 5.49 | 4.51 | 4.67 | 3.34 | 0.85 | 0.74 |
| T-18 | R-18 | 5.38 | 4600 | 112000 | 27.7 | 60 | 10.50 | 4.80 | 10.40 | 3.60 | 0.99 | 0.75 |
| T-19 | R-19 | 5.60 | 4600 | 163000 | 4.8 | 59 | 6.15 | 3.96 | 5.52 | 2.93 | 0.90 | 0.74 |
| T-20 | R-20 | 8.07 | 2400 | 155000 | 12.8 | 65 | 7.26 | 4.41 | 6.77 | 3.17 | 0.93 | 0.72 |
| T-21 | R-21 | 4.56 | 5100 | 239000 | 0.9 | 57 | 5.10 | 4.60 | 3.70 | 3.40 | 0.73 | 0.74 |
| T-22 | R-22 | 10.45 | 4000 | 138000 | 11.5 | 65 | 8.40 | 3.70 | 7.90 | 2.30 | 0.94 | 0.62 |
| T-23 | R-23 | 4.02 | 7400 | 132000 | 13.6 | 60 | 4.78 | 2.89 | 3.57 | 2.10 | 0.75 | 0.73 |
| T-24 | R-24 | 3.37 | 13500 | N/A | 22.5 | 58 | 3.90 | 4.34 | 3.00 | 2.66 | 0.77 | 0.61 |
| T-25 | R-25 | 5.43 | 4700 | 87000 | 5.3 | 58 | 1.57 | 2.41 | 0.95 | 1.59 | 0.60 | 0.66 |
| T-26 | R-26 | 8.66 | 4600 | 146000 | 10.9 | 63 | 8.00 | 4.70 | 7.30 | 3.80 | 0.91 | 0.81 |
| T-27 | R-27 | 4.19 | 4600 | 136000 | 13.1 | 56 | 8.20 | 4.20 | 7.60 | 2.70 | 0.93 | 0.64 |
| T-28 | R-28 | 5.00 | 4600 | 97000 | 30.1 | 59 | 11.10 | 6.20 | 12.30 | 4.20 | 1.11 | 0.68 |
| T-29 | R-29 | 6.00 | 4600 | 278000 | 0.3 | 59 | 5.03 | 5.17 | 3.06 | 3.83 | 0.61 | 0.74 |
| T-30 | R-30 | 10.38 | 2400 | 140000 | 12.9 | 65 | 7.80 | 5.10 | 7.10 | 4.30 | 0.91 | 0.84 |
| T-31 | R-31 | 7.58 | 4600 | 90000 | 2.2 | 59 | 2.63 | 2.44 | 2.03 | 1.67 | 0.77 | 0.68 |

TABLE 6-continued

| | | | Physical properties | | | | | | | | | |
|---|---|---|---|---|---|---|---|---|---|---|---|---|
| | | | Molecular weight | | THF insoluble | | G' | G" | G' | G" | G' (165° C.)/ G' | G" (165° C.)/ G" |
| Toner | Resin | S/A | 1st peak | 2nd peak | content Mass % | Tg ° C. | (155° C.) ×1000 Pa | (155° C.) ×1000 Pa | (165° C.) ×1000 Pa | (165° C.) ×1000 Pa | (155° C.) — | (155° C.) — |
| T-32 | R-32 | 4.34 | 4600 | 210000 | 33.5 | 60 | 21.20 | 13.80 | 20.99 | 10.90 | 0.99 | 0.79 |
| T-33 | R-33 | 5.64 | 4600 | 275000 | 0.2 | 59 | 4.80 | 5.03 | 2.92 | 3.71 | 0.61 | 0.74 |
| T-34 | R-34 | 5.85 | 4600 | 288000 | 0 | 59 | 4.56 | 4.88 | 2.78 | 3.58 | 0.61 | 0.73 |

Examples 1 to 20 and Comparative Examples 1 to 14

3 mass parts of a toner for electrophotography T-1 was mixed with 97 mass parts of a carrier (F-150, a product of Powdertech Corp.) to obtain a developing agent, with which an image was drawn by using a copier produced by remodeling a commercial high-speed copier. And then the toner was evaluated. With respect to other toners, developing agents were prepared and evaluated in the same manner. The results thus evaluated are shown in Table 7. As clear from the results of Table 7, all of the toners for electrophotography of the present invention exhibited excellent toner performance.

TABLE 7

| Example/ Comp. Example No. | Name of toner | Fixing properties | Offset resistance | Cleaning properties | Storage stability | Durability | Productivity |
|---|---|---|---|---|---|---|---|
| Example 1 | T-1 | ○ | ○ | ○ | ○ | ○ | ○ |
| Example 2 | T-2 | ○ | ○ | ○ | ○ | ○ | ○ |
| Example 3 | T-3 | ○ | ○ | ○ | ○ | ○ | ○ |
| Example 4 | T-4 | Δ | ○ | ○ | ○ | ○ | Δ |
| Example 5 | T-5 | ○ | ○ | ○ | ○ | Δ | ○ |
| Example 6 | T-6 | ○ | ○ | ○ | ○ | ○ | ○ |
| Example 7 | T-7 | Δ | ○ | ○ | ○ | ○ | ○ |
| Example 8 | T-8 | ○ | Δ | ○ | ○ | ○ | ○ |
| Example 9 | T-9 | ○ | ○ | ○ | ○ | ○ | ○ |
| Example 10 | T-10 | ○ | ○ | ○ | ○ | ○ | ○ |
| Example 11 | T-11 | ○ | ○ | ○ | ○ | ○ | ○ |
| Example 12 | T-12 | ○ | ○ | ○ | ○ | ○ | ○ |
| Example 13 | T-13 | ○ | ○ | ○ | ○ | ○ | ○ |
| Example 14 | T-14 | ○ | ○ | ○ | ○ | ○ | ○ |
| Example 15 | T-15 | ○ | Δ | ○ | ○ | ○ | ○ |
| Example 16 | T-16 | Δ | ○ | ○ | ○ | ○ | ○ |
| Example 17 | T-17 | ○ | ○ | ○ | ○ | ○ | ○ |
| Example 18 | T-18 | ○ | ○ | ○ | ○ | ○ | ○ |
| Example 19 | T-19 | ○ | ○ | ○ | ○ | ○ | ○ |
| Example 20 | T-20 | Δ | ○ | ○ | ○ | ○ | ○ |
| Comp. Example 1 | T-21 | Δ | X | ○ | ○ | ○ | X |
| Comp. Example 2 | T-22 | Δ | X | X | ○ | X | ○ |
| Comp. Example 3 | T-23 | X | ○ | ○ | ○ | ○ | ○ |
| Comp. Example 4 | T-24 | X | ○ | ○ | Δ | ○ | ○ |
| Comp. Example 5 | T-25 | ○ | X | X | ○ | X | ○ |
| Comp. Example 6 | T-26 | X | ○ | ○ | ○ | ○ | ○ |
| Comp. Example 7 | T-27 | ○ | X | ○ | ○ | ○ | ○ |
| Comp. Example 8 | T-28 | X | X | ○ | ○ | ○ | ○ |
| Comp. Example 9 | T-29 | X | X | ○ | ○ | ○ | X |
| Comp. Example 10 | T-30 | X | ○ | ○ | ○ | ○ | ○ |
| Comp. Example 11 | T-31 | ○ | X | X | ○ | X | ○ |
| Comp. Example 12 | T-32 | X | ○ | ○ | ○ | ○ | X |
| Comp. Example 13 | T-33 | X | X | ○ | ○ | ○ | X |
| Comp. Example 14 | T-34 | X | X | ○ | ○ | ○ | X |

The invention claimed is:

1. A toner for electrophotography containing at least a binder resin, wherein (a) the tetrahydrofuran (THF) soluble content in the toner has a first peak in the molecular weight region of not less than 2,400 but less than 5,000 and a second peak in the molecular weight region of not less than 100,000 but less than 200,000 in the chromatogram obtained by gel permeation chromatography (GPC); (b) said binder resin contains at least a carboxyl group-containing vinyl resin (C) and a glycidyl group-containing vinyl resin (E); and (c) the mass ratio of the styrene monomer to the acrylic monomer in said binder resin, namely (S/A), is not less than 4.6 but less than 8.5.

2. The toner for electrophotography as set forth in claim 1, wherein, in the measurement frequency of 6.28 rad/s, both of the storage modulus G' at 155 degrees centigrade: G'(155 degrees centigrade) and the storage modulus G' at 165 degrees centigrade; G' (165 degrees centigrade) are not less than $1.0\times10^3$ Pa but not more than $2.0\times10^4$ Pa; both of the loss modulus G" at 155 degrees centigrade; G"(155 degrees centigrade) and the loss modulus G" at 165 degrees centigrade; G"(165 degrees centigrade) are not less than $1.0\times10^3$ Pa but not more than $1.5\times10^4$ Pa; G' (165 degrees centigrade)/G' (155 degrees centigrade) is not less than 0.80 but not more than 1.10; and G" (165 degrees centigrade)/G" (155 degrees centigrade) is not less than 0.65 but not more than 0.85.

3. The toner for electrophotography as set forth in claim 1, wherein the THF insoluble component derived from the binder resin is contained in an amount of not less than 1 but less than 30 mass %.

4. A method for producing the toner for electrophotography as set forth in claim 1 comprising a step of kneading a binder resin satisfying all of the following conditions (i) to (viii) and at least a colorant in the melt state and then grinding, (i) the THF soluble content in said binder resin has a first peak in the molecular weight region of not less than 2,400 but less than 5,000 and a second peak in the molecular weight region of not less than 150,000 but less than 350,000 in the chromatogram obtained by GPC;

(ii) said binder resin contains at least a carboxyl group-containing vinyl resin (C) and a glycidyl group-containing vinyl resin (E);

(iii) the mass ratio of the styrene monomer to the acrylic monomer in said binder resin, namely (S/A), is not less than 4.6 but less than 8.5;

(iv) the carboxyl group-containing vinyl resin (C) contains a high molecular weight vinyl resin (H) in which the THF soluble content has a peak in the molecular weight region of not less than 150,000 but less than 350,000 in the chromatogram obtained by GPC and a low molecular weight vinyl resin (L) in which the THF soluble content has a peak in the molecular weight region of not less than 2,000 but less than 5,000 in the chromatogram obtained by GPC;

(v) the mass ratio of the high molecular weight vinyl resin (H) to the low molecular weight vinyl resin (L) in the carboxyl group-containing vinyl resin (C), namely (H/L), is not less than 30/70 but not more than 50/50;

(vi) the acid value of the carboxyl group-containing vinyl resin (C) is not less than 3 but not more than 16 mgKOH/g;

(vii) The glycidyl group-containing vinyl resin (E) has the THF soluble content which has a peak in the molecular weight region of not less than 20,000 but not more than 80,000 in the chromatogram obtained by GPC and the epoxy value of resin (E) is not less than 0.003 but not more than 0.100 Eq/100 g; and (viii) the mass ratio of the carboxyl group-containing vinyl resin (C) to the glycidyl group-containing vinyl resin (E), namely (C/E), is not less than 87/13 but not more than 99/1.

5. The method for producing the toner for electrophotography as set forth in claim 4, in which a binder resin containing the THF insoluble component in an amount of not less than 0.1 but not more than 20 mass % is used.

6. The method for producing the toner for electrophotography as set forth in claim 4, in which the acid value of said high molecular weight vinyl resin (H) in said binder resin, namely (AVH), is not less than 3.0 but not more than 32.5 mgKOH/g; the acid value of said low molecular weight vinyl resin (L), namely (AVL), is not less than 1.3 but not more than 16.5 mgKOH/g; and AVH is greater than AVL (AVH>AVL).

7. The method for producing the toner for electrophotography as set forth in claim 4, in which said binder resin is obtained by melt-kneading at least one carboxyl group-containing vinyl resin (C) and at least one glycidyl group-containing vinyl resin (E) at a temperature range of not less than 140 but not more than 230 degrees centigrade and reacting the carboxyl group with the glycidyl group.

* * * * *